US011049641B2

(12) United States Patent
Ohkubo et al.

(10) Patent No.: US 11,049,641 B2
(45) Date of Patent: Jun. 29, 2021

(54) COIL DEVICE

(71) Applicant: TDK Corporation, Tokyo (JP)

(72) Inventors: Hitoshi Ohkubo, Tokyo (JP); Kyohei Tonoyama, Tokyo (JP); Shigeki Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/363,938

(22) Filed: Nov. 29, 2016

(65) Prior Publication Data

US 2017/0154720 A1 Jun. 1, 2017

(30) Foreign Application Priority Data

Nov. 30, 2015 (JP) ..... JP2015-233489

(51) Int. Cl.

| | |
|---|---|
| ***H01F 5/00*** | (2006.01) |
| ***H01F 27/255*** | (2006.01) |
| ***H01F 17/00*** | (2006.01) |
| ***H01F 17/04*** | (2006.01) |
| ***H01F 27/02*** | (2006.01) |
| ***H01F 27/28*** | (2006.01) |
| ***H01F 27/29*** | (2006.01) |

(Continued)

(52) U.S. Cl.

CPC ..... *H01F 27/255* (2013.01); *H01F 17/0013* (2013.01); *H01F 17/04* (2013.01); *H01F 27/022* (2013.01); *H01F 27/2804* (2013.01); *H01F 27/292* (2013.01); *H01F 27/324* (2013.01); *H01F 27/42* (2013.01); *H01F 2017/048* (2013.01); *H01F 2027/2809* (2013.01)

(58) Field of Classification Search

USPC ..... 336/233

See application file for complete search history.

(56) References Cited

U.S. PATENT DOCUMENTS 6,051,324 A * 4/2000 Moorhead ..... H01F 1/24 428/403

2008/0231409 A1* 9/2008 Kugai ..... H01F 1/24 336/233

(Continued)

FOREIGN PATENT DOCUMENTS

CN 101901668 A 12/2010

JP 2008041685 A 2/2008

(Continued)

OTHER PUBLICATIONS

Korean Office Action of related Korean Patent Application No. 10-2015-0187274 dated Apr. 19, 2017.

*Primary Examiner* — Ronald Hinson

(74) *Attorney, Agent, or Firm* — Arent Fox LLP

(57) ABSTRACT

A coil device comprising a coil, and a magnetic metal powder containing resin covering said coil. Said magnetic metal powder comprises at least two types of magnetic metal powders with different D50. The magnetic metal powder having larger D50 is defined as a large diameter powder, and the magnetic metal powder having smaller D50 is defined as a small diameter powder among the two types of said magnetic metal powder. Said large diameter powder is made of iron or iron based alloy. Said small diameter powder is made of Ni—Fe alloy. Said small diameter powder has D50 of 0.5 to 1.5 μm. Said large diameter powder and said small diameter powder respectively comprises an insulation coating layer.

15 Claims, 18 Drawing Sheets

(51) Int. Cl.
*H01F 27/32* (2006.01)
*H01F 27/42* (2006.01)

(56) References Cited

U.S. PATENT DOCUMENTS

2010/0289609 A1 11/2010 Liao et al.
2012/0024109 A1* 2/2012 Xu ..... B22F 1/025 75/243
2013/0182460 A1* 7/2013 Marusawa ..... C01G 49/08 363/13
2013/0249664 A1* 9/2013 Tonoyama ..... H01F 41/04 336/200
2014/0002221 A1* 1/2014 Shin ..... H01F 17/04 336/83
2014/0077914 A1* 3/2014 Ohkubo ..... H01F 5/00 336/177
2014/0132383 A1* 5/2014 Matsuura ..... B22F 1/02 336/83
2014/0286814 A1* 9/2014 Kotani ..... C22C 38/00 419/30
2015/0028983 A1 1/2015 Ryu et al.
2015/0235753 A1* 8/2015 Chatani ..... H01F 27/245 336/200
2016/0055955 A1* 2/2016 Park ..... H01F 27/255 336/83
2016/0086717 A1* 3/2016 Harada ..... H01F 27/255 336/233

FOREIGN PATENT DOCUMENTS

JP 5283165 B2 9/2013
JP 2014-060284 A 4/2014
KR 1020150001385 A 1/2015
KR 1020150014415 A 2/2015

* cited by examiner

COIL DEVICE

BACKGROUND OF THE INVENTION

Field of the Invention

The present invention relates to a coil device, and particularly relates to the coil device preferably used as the power inductor or so such as a choke coil for a power smooth circuit in the electronics.

Description of the Related Art

In the field of the electronic device for the consumer use or the industrial use, the coil device of a surface mounting type is frequently used as an inductor for the power source. This is because the coil device of the surface mounting type is compact and thin, and has excellent electric insulation, and also it can be produced in low cost. As one of the specific structures of the coil device of the surface mounting type, there is a flat coil structure which utilizes the print circuit board technology.

As one of the methods for improving the inductance of the coil, a method of improving the magnetic permeability of the magnetic path may be mentioned. In order to improve the magnetic permeability of the magnetic path of the above mentioned device, it is necessary to increase the filling rate of the metal powder in the magnetic metal powder containing resin layer. In order to increase the filling rate of the metal powder, it is effective to fill the space between the metal powders having large particle diameter with the metal powders having small particle diameter. However, if it is filled too much and the contact between the metal powders is excessively increased, the core loss increases, hence the DC superimposition characteristic deteriorates.

Thus, the patent document 1 proposes the coil devices. According to this coil device, the inductance can be improved while suppressing the increase of the core loss.

However, in the recent years, the coil device with various improved characteristics such as the magnetic permeability and the core loss or so are in needs.

[Patent document 1] JP Patent Application Laid Open No. 2014-60284

SUMMARY OF THE INVENTION

The present invention is achieved in view of such circumstance, and the object of the present invention is to provide the coil device having excellent initial magnetic permeability, core loss and withstand voltage; and to provide the magnetic metal powder containing resin capable of producing the coil device having excellent initial magnetic permeability, core loss and withstand voltage.

Means for Solving the Problems

A coil device comprising a coil, and a magnetic metal powder containing resin covering said coil, wherein said magnetic metal powder comprises at least two types of magnetic metal powders with different D50, the magnetic metal powder having larger D50 is defined as a large diameter powder, and the magnetic metal powder having smaller D50 is defined as a small diameter powder among the two types of said magnetic metal powder, said large diameter powder is made of iron or iron based alloy, said small diameter powder is made of Ni—Fe alloy, said small diameter powder has D50 of 0.5 to 1.5 μm, and said large diameter powder and said small diameter powder respectively comprises an insulation coating layer.

The coil device according to the present invention obtains excellent initial magnetic permeability, core loss and withstands voltage by using the magnetic metal powder comprising the above mentioned characteristics.

The magnetic metal powder according to the present invention is the magnetic metal powder used for the above mentioned coil device. By using the magnetic metal powder containing resin according to the present invention, the coil device having excellent initial magnetic permeability, core loss and withstand voltage can be formed.

Said large diameter powder preferably has D50 of 15 to 40 μm.

Said small diameter powder preferably has D50 of 0.5 to 1.0 μm (1.0 μm not included).

Said small diameter powder preferably has D90 of 4.0 μm or less.

At least said small diameter powder is preferably spherical.

The content ratio of Ni in said Ni—Fe alloy is preferably 75 to 82%.

The blending ratio of said small diameter powder in said entire magnetic metal powder is preferably 5 to 25%.

The thickness of said insulation coating layer is preferably 5 to 45 nm.

Said insulation coating layer preferably includes a glass comprising $SiO_2$.

Said insulation coating layer preferably includes phosphates.

Also, said magnetic metal powder may comprise an intermediate diameter powder wherein D50 of said intermediate diameter powder is smaller than that of said large diameter powder and larger than said small diameter powder.

Said intermediate diameter powder preferably comprises the insulation coating layer.

Said intermediate diameter powder preferably has D50 of 3.0 to 10 μm.

Said intermediate diameter powder preferably comprises iron or iron based alloy.

The blending ratio of said large diameter powder in said entire magnetic metal powder is preferably 70 to 80%, and the blending ratio of said intermediate diameter powder is preferably 10 to 15%, and the blending ratio of said small diameter powder is preferably 10 to 15%.

DESCRIPTION OF THE PREFERRED EMBODIMENTS

Hereinafter, the present invention will be described based on the embodiments shown in the figures.

Figure 1:
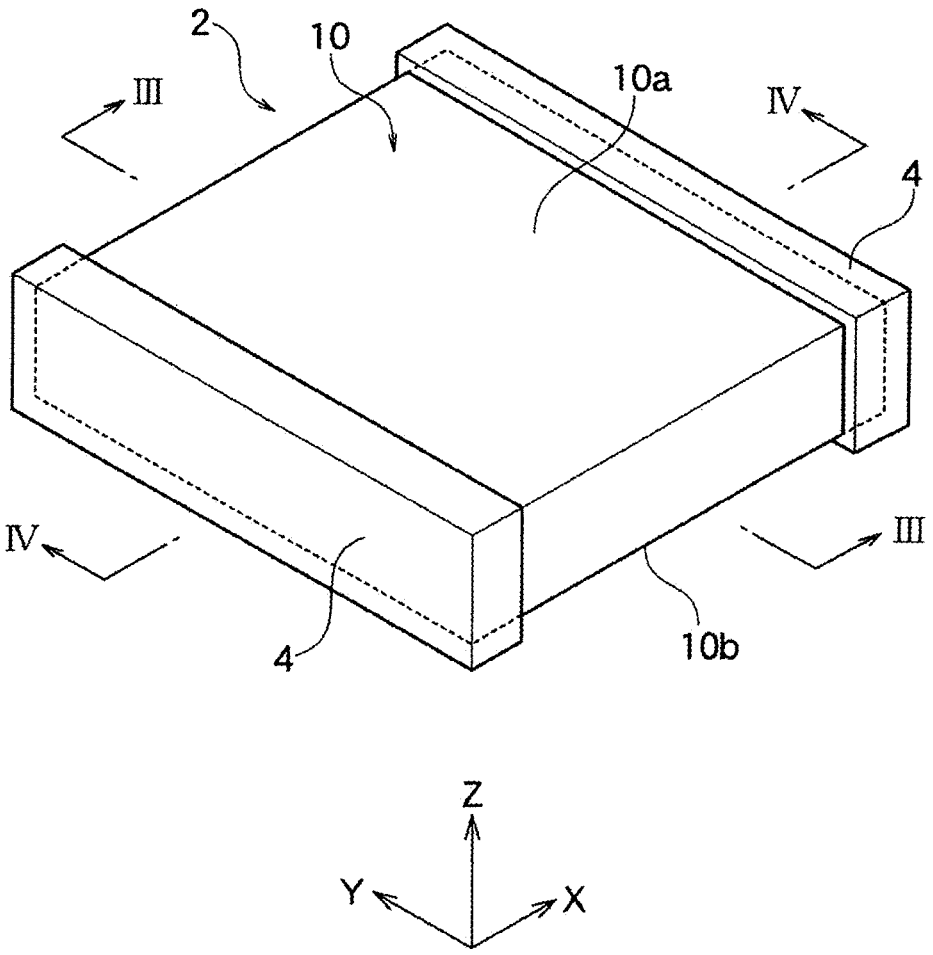
FIG. 1 is a perspective view of the coil device according to one embodiment of the present embodiment.

As one embodiment of the coil device according to the present invention, the coil device shown in FIG. 1 to FIG. 4 may be mentioned. As shown in FIG. 1, the coil device 2 comprises the core element 10 having a rectangular flat plate shape, and a pair of terminal electrodes 4, 4 which are mounted at both ends in X axis direction of the core element 10. The terminal electrodes 4, 4 covers the end surface in X axis direction of the core element 10, and also the terminal electrodes 4,4 partially covers a upper surface 10*a* and lower surface 10*b* in Z axis direction of the core element 10 near the end surface of X axis direction. Further, the terminal electrodes 4, 4 partially cover a pair of side surfaces in Y axis direction of the core element 10.

Figure 2:
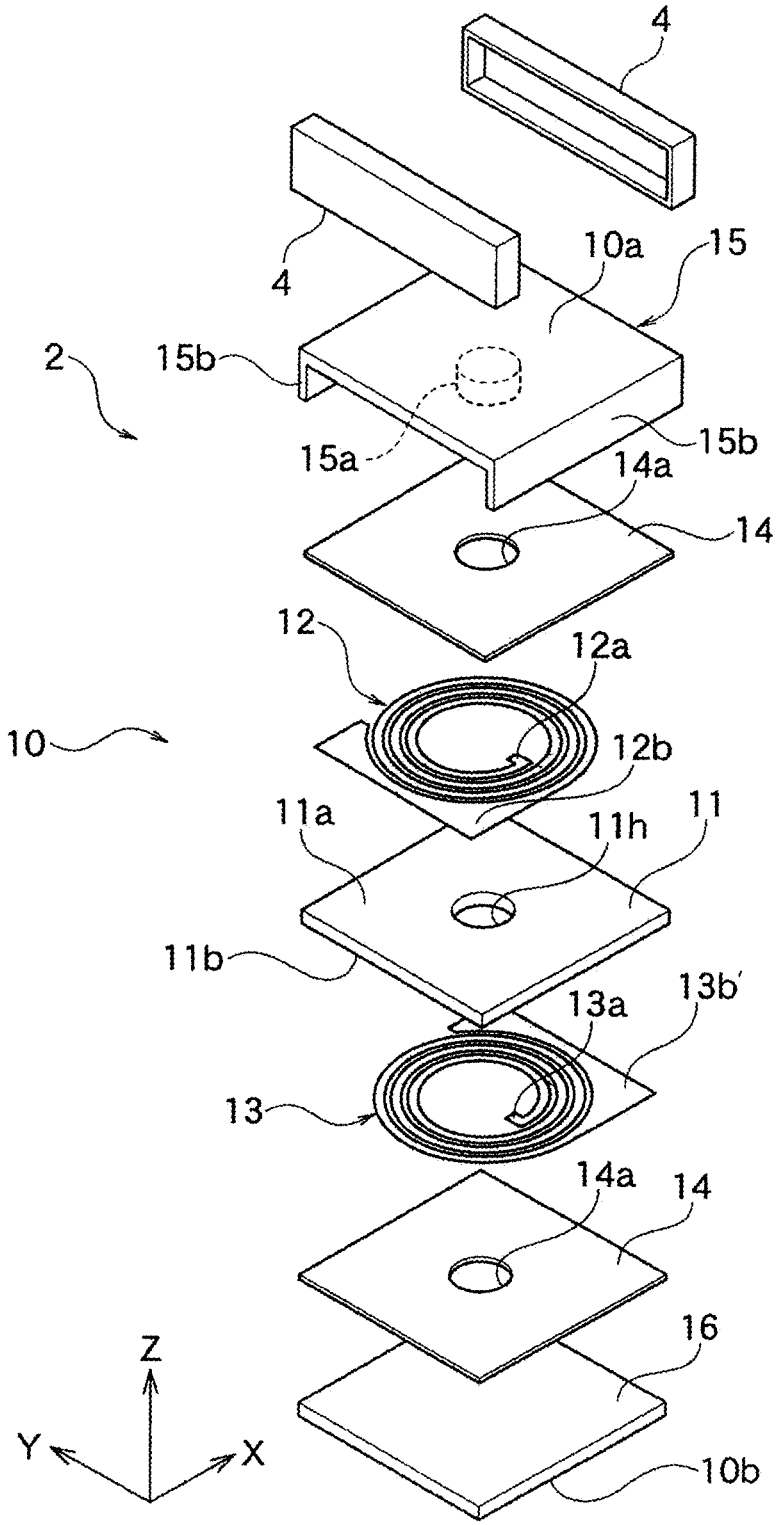
FIG. 2 is an exploded perspective view of the coil device shown in FIG. 1.

As shown in FIG. 2, the core element 10 is made of an upper core 15 and lower core 16, and comprises the insulation board 11 at the center part of Z axis direction.

The insulation board 11 is preferably the general board material wherein the epoxy resin is impregnated with a glass cross, however it is not particularly limited.

Also, in the present invention, the shape of the insulation board 11 is a rectangular shape; however it may be different shape. The method for forming the insulation board 11 is not particularly limited, and for example it may be formed by an injection molding, doctor blade method, screen printing or so.

Also, at the upper surface (one of the main surface) in Z axis direction of the insulating board 11, the internal electrode pattern made of internal conductor path 12 having a circular spiral shape is formed. The internal conductor path 12 will be the coil at the end. Also, the material of the internal conductor path 12 is not particularly limited.

At the inner peripheral end of the internal conductor path 12 having the spiral form, the connecting end 12*a* is formed. Also, at the outer peripheral end of the internal conductor path 12 having the spiral form, the lead contact 12*b* is formed so that it is exposed along X axis direction of one of the core element 10.

At the lower surface (other main surface) in Z axis direction of the insulation board 11, the internal electrode pattern made of the internal conductor path 13 having the spiral shape is formed. The internal conductor path 13 will be formed into a coil. Also, the material of the internal conductor path 13 is not particularly limited.

At the internal peripheral end of the internal conductor path 13 having the spiral shape, the connecting end 13*a* is formed. Also, at the outer peripheral end of the internal conductor path 13 having the spiral shape, the lead contact 13*b* is formed so that it is exposed along X axis direction of one of the core element 10.

Figure 3:
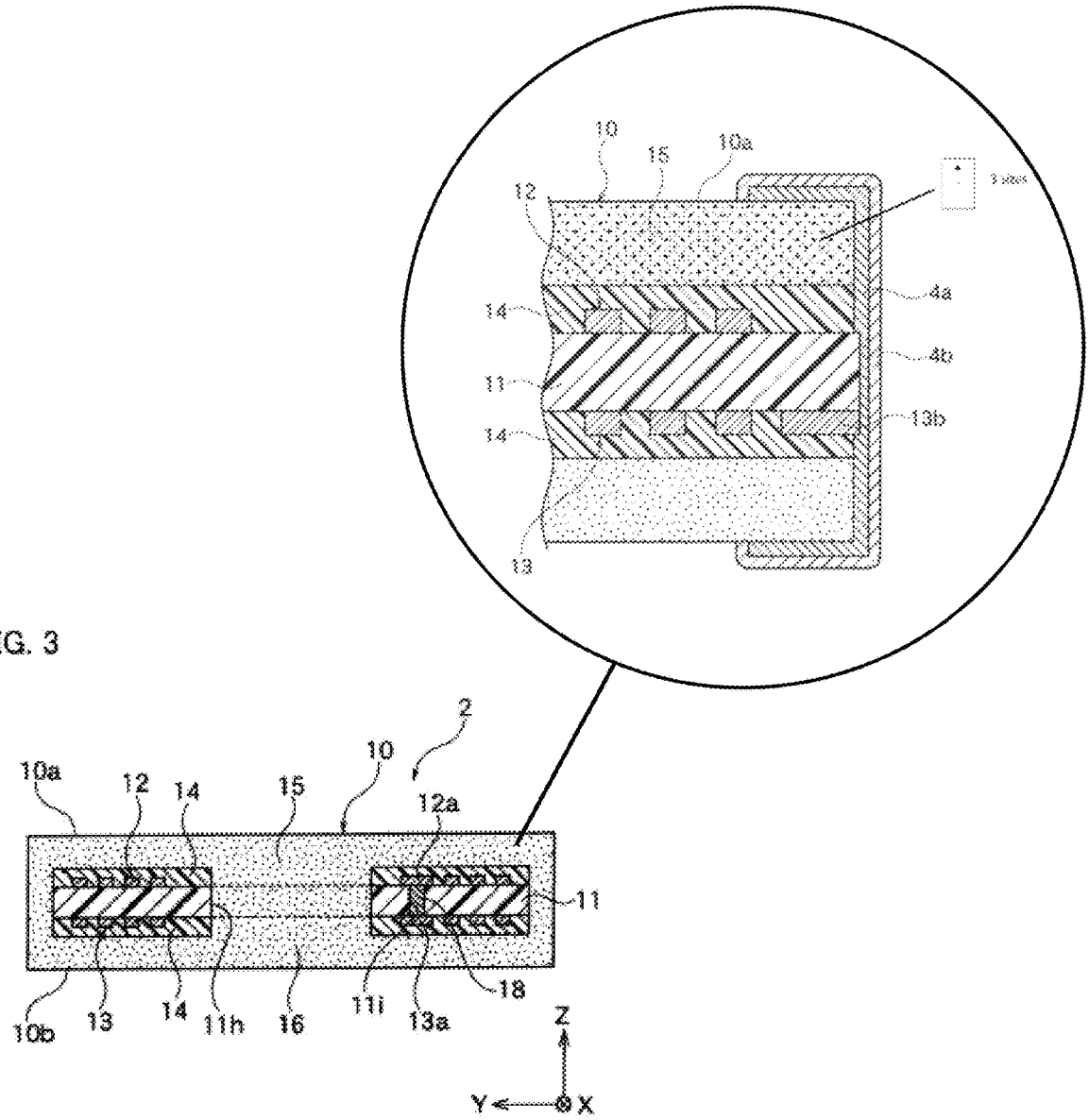
FIG. 3 is a cross section along III-III line shown in FIG. 1.

As shown in FIG. 3, the connecting end 12*a* and the connecting end 13*a* are formed at the opposite side across the insulation board 11 in Z axis direction. The connecting terminal 12*a* and the connecting terminal 13*a* are formed at the same position in X axis direction and Y axis direction. Further, the connecting end 12*a* and the connecting end 13*a* are electrically connected via the through hole electrode 18 embedded in the through hole 11*i* formed at the insulation board 11. That is, the internal conductor path 12 of the spiral shape and the internal conductor path 13 of the spiral shape are electrically connected in series via the through hole electrode 18. Also shown in FIG. 3 (and FIGS. 4A and 4B) are cross-sectional views of the internal conductor paths 12 and 13; and the upper core 15, and the lower core 16, one or both of which may include, for example, three or more types of magnetic metal powders (e.g., small, intermediate, and large diameter powders, as indicated).

When looking the internal conductor path 12 of the spiral shape from the upper surface 11*a* side of the insulation board 11, it constitutes the spiral shape which is in counter clockwise direction towards the connecting end 12*a* of the inner peripheral end from the lead contact 12*b* of the outer peripheral end.

On the other hand, when looking the internal conductor path 13 of the spiral shape from the upper surface 11*a* side of the insulation board 11, it constitutes the spiral shape which is in counter clockwise direction towards the lead contact 13*b* of the outer peripheral end from the connecting end 13*a* of the inner peripheral end.

Thereby, the direction of the magnetic flux generated by the electrical current flowing to the internal conductor paths 12 and 13 of the spiral shape matches, and the magnetic flux generated by the internal conductor paths 12 and 13 of the spiral shape is superimposed and becomes stronger; hence a large inductance can be obtained.

The upper core 15 comprises an intermediate leg part 15*a* of a columnar shape which projects out to the lower side in Z axis direction, at the center part of the core main body of the rectangular flat plate shape. Also, the upper core 15 comprises the side leg part 15*b* of a plate shape projecting out towards the lower side in X axis direction, at the both end parts of Y axis direction of the core main body of the rectangular flat plate shape.

The lower core 16 has a shape of the rectangular flat plate shape as similar to the core main body of the upper core 15, and the intermediate leg part 15*a* and the side leg part 15*b* of the upper core 15 are respectively connected to the end part in Y axis direction and to the center part of the lower core 16, and formed as one body.

Note that, FIG. 2 shows that the core element body 10 being separated from the upper core 15 and the lower core 16; however these may be formed as one body using the magnetic metal powder containing resin. Also, the intermediate leg part 15*a* and/or the side leg part 15*b* formed on the upper core 15 may be formed at the lower core 16. In any case, the core element body 10 is constituted to have completely closed magnetic circuit; hence no gap is present in the closed magnetic circuit.

As shown in FIG. 2, in between the upper core 15 and the internal conductor path 12, the protective insulation layer 14 is present, and these are insulated. Also, in between the lower core 16 and the internal conductor path 13, the protective insulation layer 14 of a rectangular sheet shape is present, and these are insulated. At the center part of the protective insulation layer 14, the through hole 14*a* of a circular shape is formed. Also, at the center part of the insulation board 11, the though hole 11*h* having a circular shape is formed. The intermediate leg part 15*a* of the upper core 15 extends towards the direction of the lower core 16 and connects with the center of the lower core 16 via these through hole 14*a* and the through hole 11*h*.

Figure 4A:
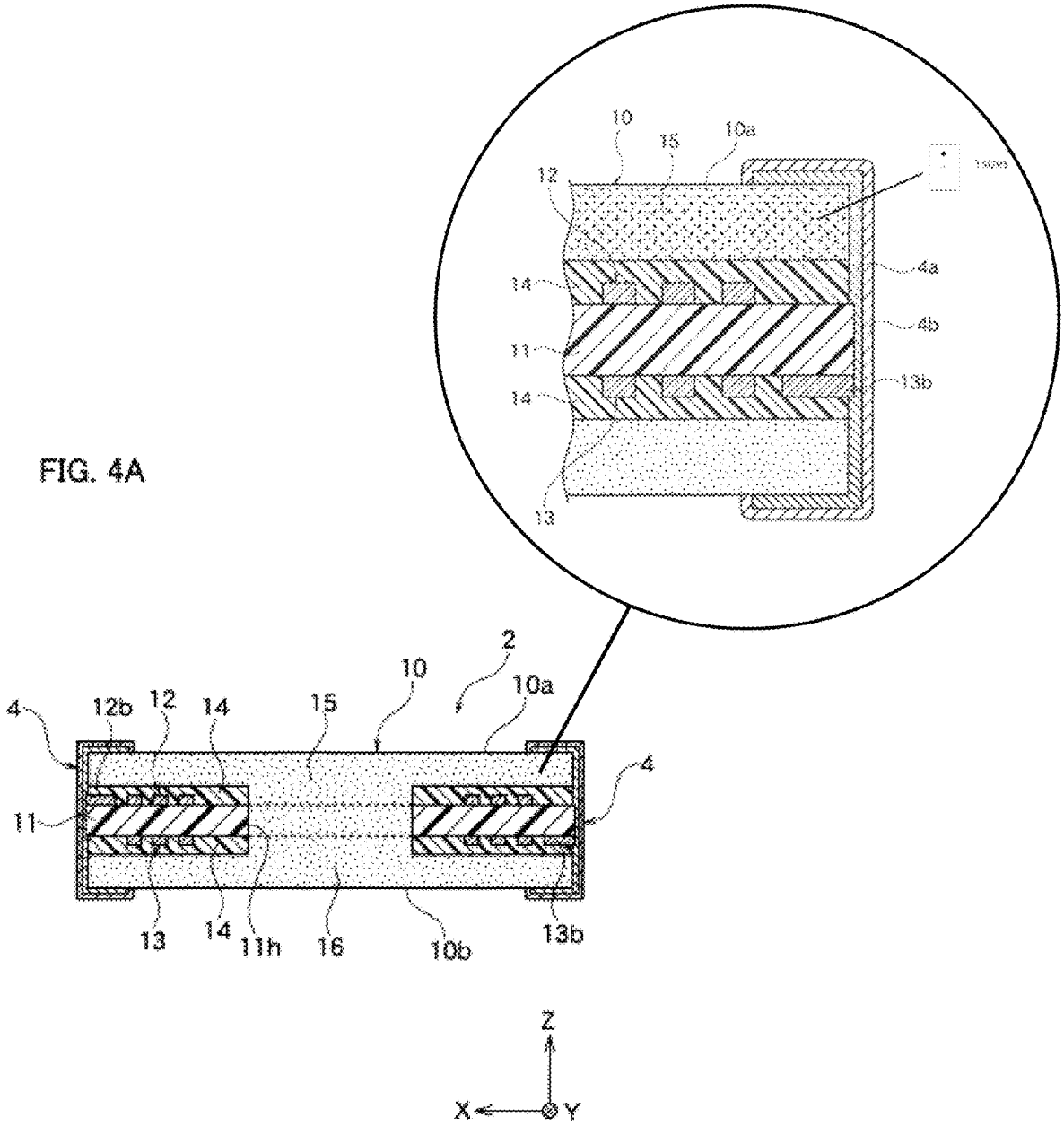
FIG. 4A is the cross section along IV-IV line shown in FIG. 1.
Figure 4B:
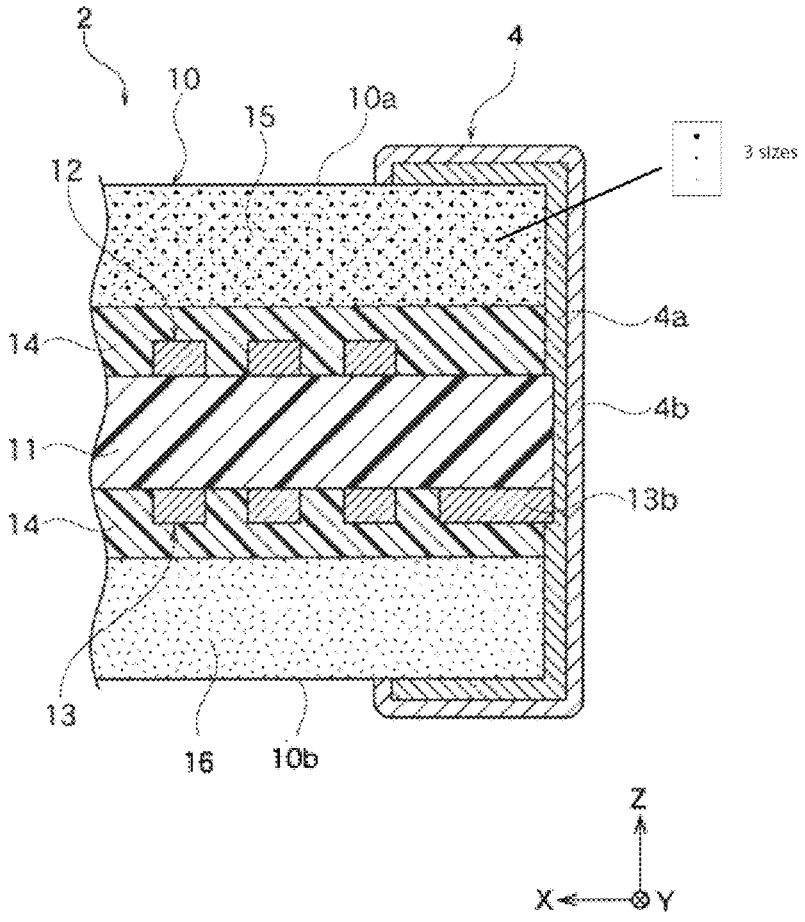
FIG. 4B is an enlarged cross section of the essential part near a terminal electrode of FIG. 4A.

As shown in FIG. 4A and FIG. 4B, in the present embodiment, the terminal electrode 4 comprises, the inner layer 4*a* which contacts with X axis direction end surface of the core element body 10, and the outer layer 4*b* formed on the surface of the inner surface 4*a*. The inner surface 4*a* partially covers the upper surface 10*a* and the lower surface 10*b* near the end surface of X axis direction of the core element body 10; and the outer layer 4*b* covers the outer surface thereof.

Here, in the present embodiment, the core element body 10 is constituted by the magnetic metal powder containing resin. The magnetic metal powder containing resin is the magnetic material wherein the magnetic metal powder is mixed in the resin.

Hereinafter, the magnetic metal powder according to the present embodiment will be explained.

The magnetic metal powder according to the present embodiment includes at least two types of the magnetic metal powders having different D50. Here, D50 refers to the diameter of the particle size when the cumulative value is 50%.

Further, among said two types of the magnetic metal powders, the magnetic metal powder having larger D50 is defined as the large diameter powder, and the magnetic metal powder having smaller D50 than the larger diameter powder is defined as the small diameter powder. As the magnetic metal powder according to the present embodiment, the large diameter powder is made of iron or iron based alloy, and the small diameter powder is Ni—Fe alloy.

The iron based alloy of the present embodiment refers to the alloy including 90 wt % or more of iron. Also, the type of the large diameter powder is not particularly limited as long as 90 wt % or more of iron is included; Fe based amorphous powder, carbonyl iron powder (pure iron powder) or so, and various Fe based alloy can be used.

Ni—Fe alloy of the present embodiment refers to the alloy including 28 wt % or more of Ni, and the rest of the part is made of Fe and other elements. The content of other contents is not particularly limited, however when the entire Ni—Fe alloy is 100 wt %, the content of other contents can be 8 wt % or less.

Figure 5:
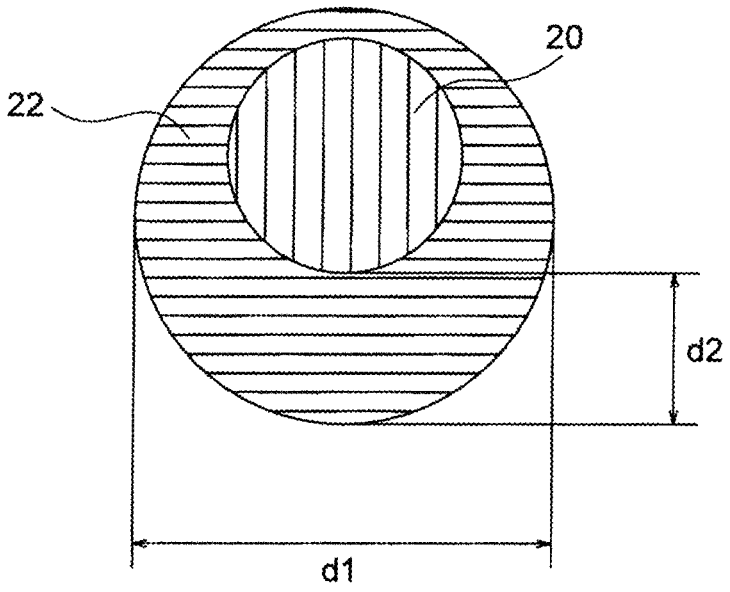
FIG. 5 is a schematic view of the magnetic metal powder comprising the insulation coating layer.

Further, as shown in FIG. 5, the magnetic metal powder according to the present embodiment comprises the insulation coating layer. Note that, "comprises the insulation coating layer" means that among the entire powder particle of said powders, 50% or more of the powder particle comprises the insulation coating layer.

The particle diameter of the magnetic metal powder of the magnetic metal powder comprising the insulation coating layer is the length d1 of FIG. 5. Also, the length d2 of FIG. 5, that is the maximum thickness of the insulation coating layer of the magnetic metal powder, is the thickness of the insulation coating layer of said magnetic metal powder. Also, the insulation coating layer does not necessarily have to cover the entire surface of the magnetic metal powder. The magnetic metal powder wherein 50% or more of the surface is covered with the insulation coating layer is considered as the magnetic metal powder comprising the insulation coating layer.

As the magnetic metal powder of the present embodiment having the above mentioned constitution, the core element body 10 having excellent initial magnetic permeability, core loss, withstand voltage, insulation resistance and DC superimposition characteristic can be obtained.

Hereinafter, the magnetic metal powder according to the present embodiment will be explained in further detail.

D50 of the lager diameter powder is not particularly limited, however preferably it is 15 to 40 μm, and more preferably 15 to 30 μm. When the large diameter powder has D50 which is within the above mentioned range, a saturated magnetic flux density and the magnetic permeability are improved.

D50 of the small diameter powder is not particularly limited, however preferably it is 0.5 to 1.5 μm, more preferably 0.5 to 1.0 μm (not including 1.0 μm), and even more preferably 0.7 to 0.9 μm. When the small diameter powder has D50 which is within the above mentioned range, the initial magnetic permeability is improved and the core loss is lowered.

The smaller the variation of the particle diameter of the small diameter powder is, the more preferable it is. Specifically, the small diameter powder has D90 (the diameter of the particle size wherein the cumulative value is 90%) of preferably 4.0 μm or less. As D90 is 4.0 μm or less, the initial magnetic permeability is improved and the core loss is reduced.

The large diameter powder and the small diameter powder are preferably spherical. In the present embodiment, spherical specifically means that the sphericity is 0.9 or more. Also, the sphericity can be measured by the image type particle size analyzer.

The content ratio of Ni in Ni—Fe alloy is preferably 40 to 85%, and more preferably 75 to 82%. By having the content ratio of Ni within the above mentioned range, the initial magnetic permeability is improved and the core loss is lowered. Note that, the above mentioned content ratio is in terms of weight ratio.

The blending ratio of the small diameter powder in the entire magnetic metal powder is preferably 5 to 25%, and more preferably 6.5 to 20%. By having the blending ratio of the small diameter powder within said range, the initial magnetic permeability improves, and the core loss is lowered. Note that, the above mentioned blending ratio is in terms of weight ratio.

The thickness of the insulation coating layer 22 is not particularly limited, however the average thickness of the insulation coating layer 22 of the small diameter powder is preferably 5 to 45 nm, and particularly preferably 10 to 35 nm. Also, the small diameter powder and the large diameter powder may have the same thickness of the insulation coating layer 22, and the thickness of the insulation coating layer 22 of the large diameter powder may be thicker than the thickness of the insulation coating layer 22 of the small diameter powder.

The material of the insulation coating layer 22 is not particularly limited, and the insulation coating layer generally used in the present technical field can be used. Preferably, it is a film including the glass made of $SiO_2$ or phosphates film including the phosphates, and particularly preferably it is the film including the glass made of $SiO_2$. Also, the method of providing the insulation coating layer is not particularly limited, and the method usually used in the present technical field can be used.

Further, the magnetic metal powder according to the present embodiment may comprise the intermediate diameter powder having smaller D50 than that of the large diameter powder and also having larger D50 than said small diameter powder.

The intermediate diameter powder preferably also comprises the insulation coating layer as similar to the large diameter powder and the small diameter powder.

Preferably, the intermediate diameter powder has D50 of 3.0 to 10 μm. When the intermediate diameter powder has D50 which is within said range, the magnetic permeability improves.

The material of the intermediate diameter powder is not particularly limited, but iron or iron based alloy is preferable as similar to the large diameter powder.

Further, as for the blending ratio of each powder in the entire magnetic metal powder, the blending ratio of the large diameter powder is preferably 70 to 80%, and the blending ratio of said intermediate diameter powder is preferably 10 to 15%, and the blending ratio of said small diameter powder is preferably 10 to 15%. As the blending ratio is within the range described in the above, particularly the core loss is lowered, and the magnetic permeability is improved.

The particle diameter and the thickness of the insulation coating layer of the large diameter powder, the intermediate diameter powder and the small diameter powder according to the present embodiment are measured by the transmission electron microscope. Note that, usually, the particle size and the material of the large diameter powder, the intermediate diameter powder and the small diameter powder according to the present invention does not substantially change during the production step of the core element body 10.

By using the above mentioned magnetic metal powder comprising the insulation coating layer as the magnetic metal powder according to the present invention, a highly dense core element body 10 can be molded under a low pressure or by non-pressure molding; and the core element body 10 having high magnetic permeability and low core loss can be obtained.

Note that, the highly dense core element body 10 can be obtained because the intermediate diameter powder and/or the small diameter powder fill the space which is formed when the large diameter powder is only used. Also, in order to increase the density of the core element body 10 even higher, the small diameter powder may be only used without using the intermediate diameter powder. By not using the intermediate diameter powder, the core element body 10 having high initial magnetic permeability than the case of using the intermediate diameter powder may be obtained in some case.

On the contrary to this, in case of using both the intermediate diameter powder and the small diameter powder, even if various conditions such as Ni content of the small diameter powder changes, it is possible to obtain the core element body 10 wherein the change of the characteristics corresponding to the changes of various conditions is small. Therefore, in case of using both of the intermediate diameter powder and the small diameter powder, the core element body 10 has higher production stability compared to the case of using only the small diameter powder.

The content of the magnetic metal powder in said magnetic metal powder containing resin is preferably 90 to 99 wt %, and more preferably 95 to 99 wt %. If the amount of the magnetic metal powder against the resin is reduced, then the saturated magnetic flux density and the magnetic permeability are lowered; on the other hand, if the amount of the magnetic metal powder is increased, then the saturated magnetic flux density and the magnetic permeability are increased; hence the saturated magnetic flux density and the magnetic permeability can be regulated by the amount of the magnetic metal powder.

The resin included in the magnetic metal powder containing resin functions as the insulation binding material. As the material of the resin, the liquid epoxy resin or the powder epoxy resin is preferably used. Also, the content ratio of the resin is preferably 1 to 10 wt %, and more preferably 1 to 5 wt %. Also, when mixing the magnetic metal powder and the resin, the magnetic metal powder containing resin solution is preferably obtained by using the resin solution. The solvent of the resin solution is not particularly limited.

Hereinafter, the method of the production of the coil device 2 will be described.

First, the internal conductor paths 12 and 13 having the spiral form are formed to the insulation board 11 by a plating method. The plating condition is not particularly limited. Also, it may be formed by the method other than the plating method.

Next, to the both surfaces of the insulation board 11 formed with the internal conductor paths 12 and 13, the protective insulation layer 14 is formed. The method of forming the protective insulation layer 14 is not particularly limited. For example, the insulation board 11 is immersed in the resin solution diluted by a high boiling point solvent, and then it is dried thereby the protective insulation layer 14 can be formed.

Next, the core element body 10 made by the combination of the upper core 15 and the lower core 16 as shown in FIG. 2 is formed. Thus, the above mentioned magnetic metal powder containing resin solution is coated on the surface of the insulation board 11 which is formed with the protective insulation layer 14. The method of coating is not particularly limited, and in general it is coated by a printing.

Next, the solvent of the magnetic metal powder containing resin solution coated by a printing is evaporated, and thereby the core element body 10 is formed.

Further, the density of the core element body 10 is improved. The method for improving the density of the core element body 10 is not particularly limited, but the method of a press treatment may be mentioned.

Further, the upper surface 11*a* and the lower surface 11*b* of the core element body 10 is ground, thereby the core element body 10 is processed to have a predetermined thickness. Then, the resin is crosslinked by heat curing. The method of grinding is not particularly limited, but the method of using the fixed grinding stone may be mentioned. Also, the temperature and the time of the heat curing are not particularly limited, and the type of the resin may be regulated accordingly.

Then, the insulation board 11 formed with the core element body 10 is cut into pieces. The method of cut is not particularly limited, but for example the method of dicing may be mentioned.

As discussed in above, the core element body 10 before formed with the terminal electrode 4 shown in FIG. 1 is obtained. Note that, at the condition prior to the cut, the core element body 10 is connected as one body in X axis direction and Y axis direction.

Also, after the cut, the core element body 10 formed into pieces are carried out with the etching treatment. As the condition of the etching treatment, it is not particularly limited.

Next, the electrode material is coated on the both ends of X axis direction of the core element body 10 which has been carried out with the etching treatment; thereby the inner layer 4*a* is formed. As the electrode material, the conductive powder containing resin wherein the conductive powder such as Ag powder or so being comprised in the heat curable resin such as epoxy resin, which is the similar epoxy resin used in the above mentioned magnetic metal powder containing resin, is used.

Next, to the product coated with the electrode paste which will be the inner layer 4*a*, the terminal plating is carried out by barrel plating; thereby the outer layer 4*b* is formed. The outer layer 4*b* may be a multilayered structure of two layers or more. The method of forming the outer layer 4*b* is not particularly limited, but for example Ni plating is carried out on the inner layer 4*a*, and then Sn plating is further carried out on Ni plating thereby the outer layer 4*b* may be formed. The coil device 2 can be produced by the above discussed method.

In the present embodiment, the core element body 10 is constituted by the magnetic metal powder containing resin, hence the resin is present in the space between the magnetic metal powder and the magnetic metal powder, thus a very small gap is formed hence the saturated magnetic flux density is increased. Therefore, the magnetic saturation can be prevented without forming the air gap between the upper core 15 and the lower core 16. Therefore, there is no need to carry out a highly precise mechanical processing to the magnetic core in order to form the gap.

In the coil device 2 according to the present embodiment, the position accuracy of the coil is highly precise by forming the coils as one body on the board surface, and also possible to make more compact and thinner. Further, in the present embodiment, the magnetic metal material is used for the magnetic article, and since it has better DC superimposition characteristic than ferrite, the magnetic gap can be skipped from forming.

Note that, the present invention is not limited to the above mentioned embodiment, and it can be variously modified within the scope of the present invention. For example, even for the embodiment other than the coil device shown in FIG. 1 to FIG. 4, as long as it is a coil device comprising the coil covered by the magnetic metal powder containing resin, it is the coil device of the present invention.

EXAMPLE

Hereinafter, the present invention will be described based on the examples.

Example 1

The toroidal core was made in order to evaluate the characteristic of the magnetic metal powder containing resin of the coil device according to the present invention. Hereinafter, the production method of the toroidal core is explained.

First, the large diameter powder, the intermediate diameter powder and the small diameter powder included in the magnetic metal powder were prepared in order to produce the magnetic metal powder included in the toroidal core. As the large diameter powder, Fe based amorphous powder (made by Epson Atmix Corporation) having D50 of 26 μm was prepared. As the intermediate diameter powder, carbonyl iron powder (pure iron powder) (made by Epson Atmix Corporation) having D50 of 4.0 μm was prepared. Further, as a small diameter powder, Ni—Fe alloy powder (made by Showa Chemical Industry Co., Ltd) wherein the Ni content ratio of 78 wt %, D50 of 0.9 μm and D90 of 1.2 μm was prepared.

Further, the large diameter powder, the intermediate diameter powder and the small diameter powder were mixed so that the blending ratio thereof is the blending ratio of Table 1 shown in below; and the magnetic metal powder was produced.

Then, the insulation film (hereinafter, it may be simply referred as glass coat) comprising the glass including $SiO_2$ was formed to said magnetic metal powder so that the insulation film of the small diameter powder has the average thickness of 20 nm. The average thickness of the insulation film of the large diameter powder and the intermediate diameter powder were formed to be thicker than the average thickness of the insulation film of the small diameter powder. Said insulation film was formed by spraying the solution including $SiO_2$ to said magnetic metal powder.

Also, the magnetic metal powder formed with the insulation film was kneaded with the epoxy resin thereby the magnetic metal powder containing resin was produced. The weight ratio of the magnetic metal powder formed with the insulation film in said magnetic metal powder containing resin was 97 wt %.

Next, the obtained magnetic metal powder containing resin was filled to the mold of toroidal shape, and the solvent was evaporated by heating for 5 hours at 100° C. Then, the press treatment was carried out and then ground by fixed grind stone, and the thickness was made to 0.7 mm. Then, the epoxy resin was crosslinked by heat curing for 90 minutes at 170° C.; thereby the toroidal core (the outer diameter of 15 mm, the inner diameter of 9 mm, and the thickness of 0.7 mm) was obtained.

Also, the obtained magnetic metal powder containing resin was filled into the mold having the predetermined rectangular parallelepiped shape. The rectangular parallelepiped shape magnetic material (4 mm×4 mm×1 mm) was obtained by the same method as the toroidal core. Further, to both end of the 4 mm×4 mm surface of either one of said rectangular parallelepiped shape magnetic material, the terminal electrode having the width of 1.3 mm was provided.

Note that, the particle diameter of the magnetic metal powder, the blending ratio of the large diameter powder, the intermediate diameter powder and the small diameter powder, D50, D90, and the thickness of the insulation film were verified that these did not change during the above mentioned production steps.

The coil was wound around said toroidal core for 32 windings, and various characteristics (the initial magnetic permeability μi, the core loss Pcv) were evaluated. The results are shown in Table 1, FIG. 6 and FIG. 7. Note that, the core loss Pcv was measured at the measuring frequency of 3 MHz.

Further, the voltage was applied between the terminal electrodes of said rectangular parallelepiped shape magnetic material, and the voltage when the current of 2 mA was flowed was measured, thereby the withstand voltage was measured. For the present example, the withstand voltage of 300 V or larger was defined good.

TABLE 1

| Sample No. | Blending ratio of large diameter powder | Blending ratio of intermediate diameter powder | Small diameter powder | | | | Insulation film |
|---|---|---|---|---|---|---|---|
| | | | Blending ratio | Ni content | D50 | D90 | |
| Example 1 | 48% | 26.0% | 26.0% | 78% | 0.9 μm | 1.2 μm | SiO2 |
| Example 2a | 50% | 25.0% | 25.0% | 78% | 0.9 μm | 1.2 μm | SiO2 |
| Example 2 | 52% | 24.0% | 24.0% | 78% | 0.9 μm | 1.2 μm | SiO2 |
| Example 3 | 56% | 22.0% | 22.0% | 78% | 0.9 μm | 1.2 μm | SiO2 |
| Example 4 | 60% | 20.0% | 20.0% | 78% | 0.9 μm | 1.2 μm | SiO2 |
| Example 5 | 63% | 18.5% | 18.5% | 78% | 0.9 μm | 1.2 μm | SiO2 |
| Example 6 | 65% | 17.5% | 17.5% | 78% | 0.9 μm | 1.2 μm | SiO2 |
| Example 7 | 70% | 15.0% | 15.0% | 78% | 0.9 μm | 1.2 μm | SiO2 |
| Example 8 | 75% | 12.5% | 12.5% | 78% | 0.9 μm | 1.2 μm | SiO2 |
| Example 9 | 80% | 10.0% | 10.0% | 78% | 0.9 μm | 1.2 μm | SiO2 |
| Example 10 | 85% | 7.5% | 7.5% | 78% | 0.9 μm | 1.2 μm | SiO2 |
| Example 11 | 87% | 6.5% | 6.5% | 78% | 0.9 μm | 1.2 μm | SiO2 |
| Example 12 | 90% | 5.0% | 5.0% | 78% | 0.9 μm | 1.2 μm | SiO2 |
| Example 13 | 94% | 3.0% | 3.0% | 78% | 0.9 μm | 1.2 μm | SiO2 |
| Comparative example 1 | 100% | 0.0% | 0.0% | | | | SiO2 |

| Sample No. | Type of large diameter powder | Type of small diameter powder | Evaluation result | | |
|---|---|---|---|---|---|
| | | | μi | Pcv (at 3 MHz) | Withstand voltage (V) |
| Example 1 | Fe based amorphous powder | Fe—Ni powder | 32.0 | 954.5 | 489 |
| Example 2a | Fe based amorphous powder | Fe—Ni powder | 34.5 | 954.6 | 490 |
| Example 2 | Fe based amorphous powder | Fe—Ni powder | 35.0 | 954.6 | 490 |
| Example 3 | Fe based amorphous powder | Fe—Ni powder | 36.8 | 954.6 | 491 |
| Example 4 | Fe based amorphous powder | Fe—Ni powder | 37.7 | 954.7 | 492 |
| Example 5 | Fe based amorphous powder | Fe—Ni powder | 38.0 | 954.8 | 488 |
| Example 6 | Fe based amorphous powder | Fe—Ni powder | 38.2 | 954.8 | 489 |
| Example 7 | Fe based amorphous powder | Fe—Ni powder | 38.5 | 954.9 | 488 |
| Example 8 | Fe based amorphous powder | Fe—Ni powder | 39.0 | 955.0 | 487 |
| Example 9 | Fe based amorphous powder | Fe—Ni powder | 39.0 | 955.0 | 489 |
| Example 10 | Fe based amorphous powder | Fe—Ni powder | 38.6 | 955.1 | 488 |
| Example 11 | Fe based amorphous powder | Fe—Ni powder | 38.4 | 955.1 | 490 |
| Example 12 | Fe based amorphous powder | Fe—Ni powder | 36.6 | 955.2 | 491 |
| Example 13 | Fe based amorphous powder | Fe—Ni powder | 34.0 | 955.3 | 489 |
| Comparative example 1 | Fe based amorphous powder | | 31.0 | 955.5 | 490 |

Figure 6:
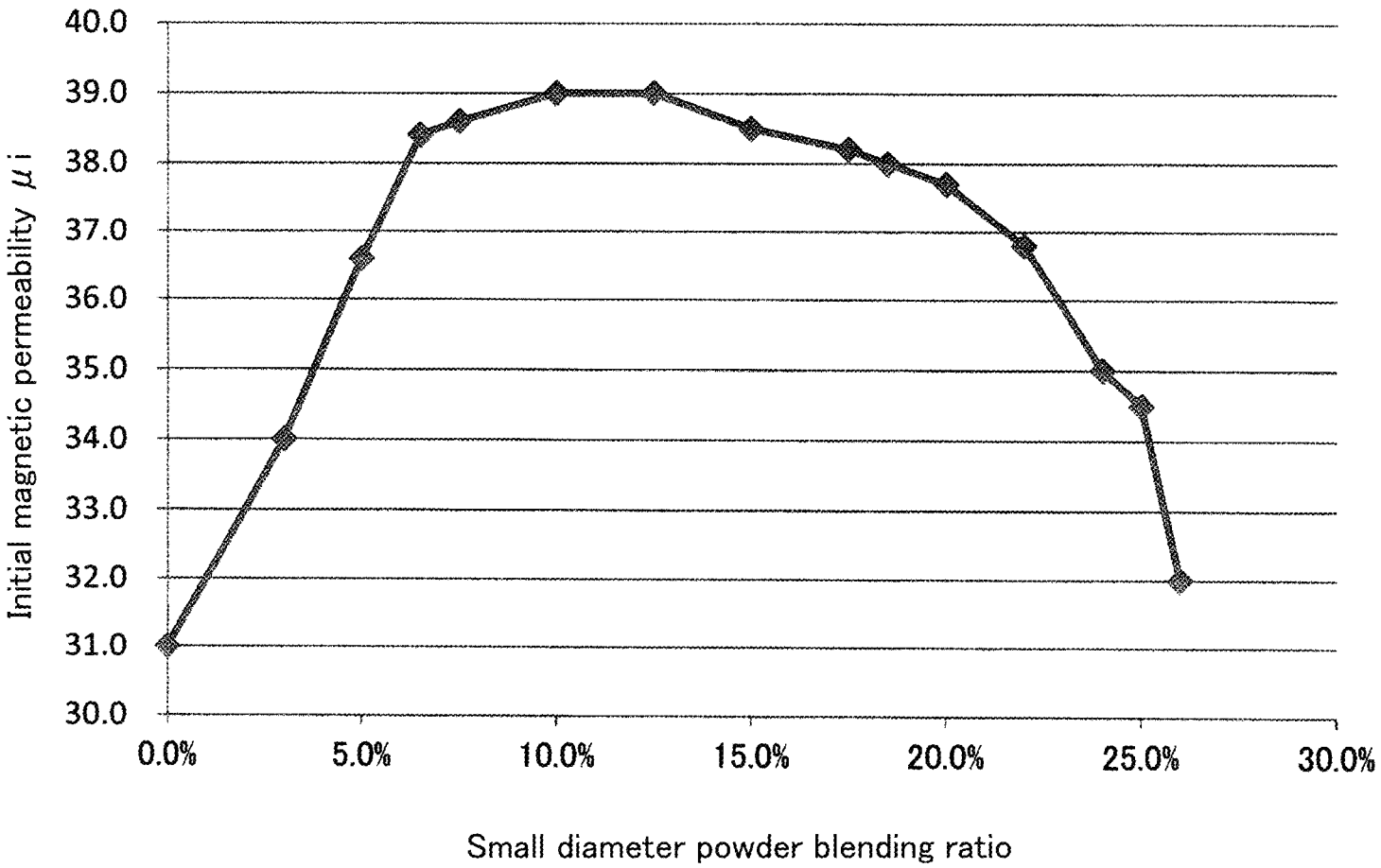
FIG. 6 is the graph showing the relation between the blending ratio of the small diameter powder and the initial magnetic permeability.
Figure 7:
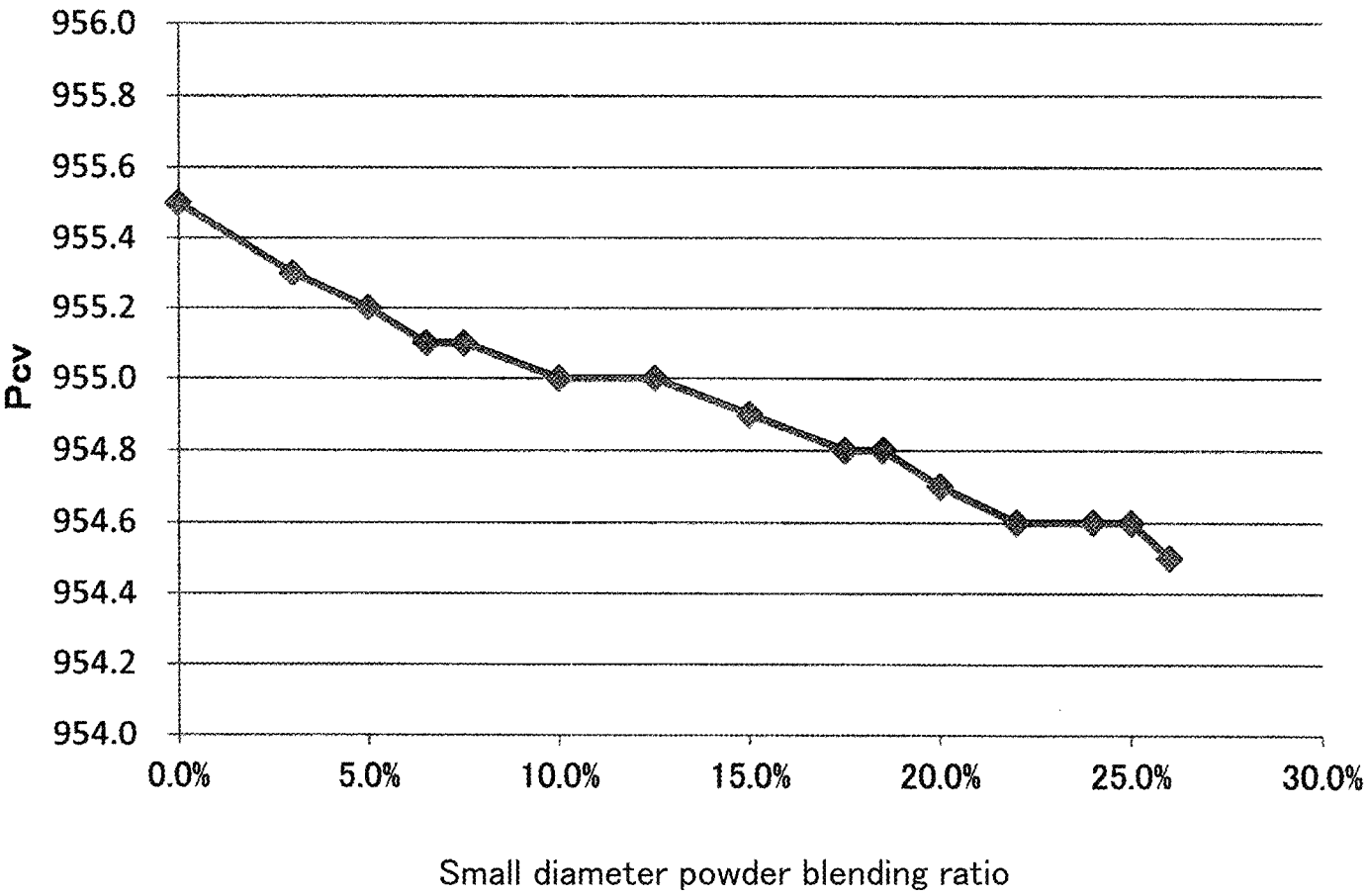
FIG. 7 is the graph showing the relation between the blending ratio of the small diameter powder and Pcv.

According to Table 1, FIG. 6 and FIG. 7, the toroidal core (the examples 1 to 13) including the large diameter powder comprising Fe based amorphous powder and the small diameter powder comprising Ni—Fe alloy, and using the magnetic metal powder formed with the insulation film has excellent initial magnetic permeability than the comparative example 1 which consists only from the large diameter powder, and also all of other characteristics were same or better than the comparative example 1. Also, the toroidal core (the examples 2a, 2 to 12) wherein the content ratio of the small diameter powder was 5 to 25% had the initial magnetic permeability of 34.5 or more, which was even more preferable initial magnetic permeability. Further, the toroidal core (the examples 4 to 11) wherein the content ratio of the small diameter powder of 6.5 to 20% had the initial magnetic permeability of 37.0 or more, which was even more preferable initial magnetic permeability.

Example 2

Figure 8:
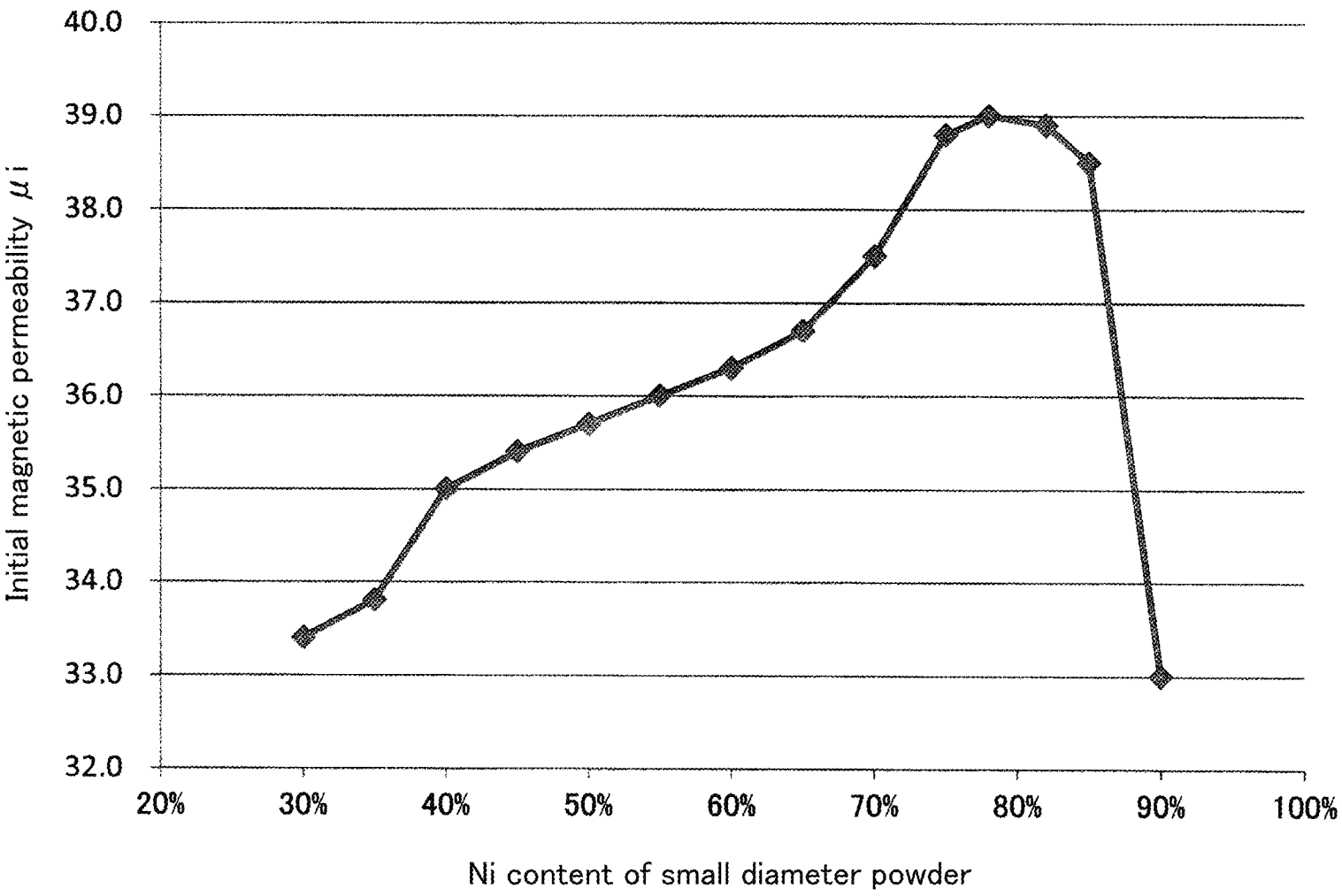
FIG. 8 is the graph showing the relation between the Ni content ratio of the small diameter powder and the initial magnetic permeability.
Figure 9:
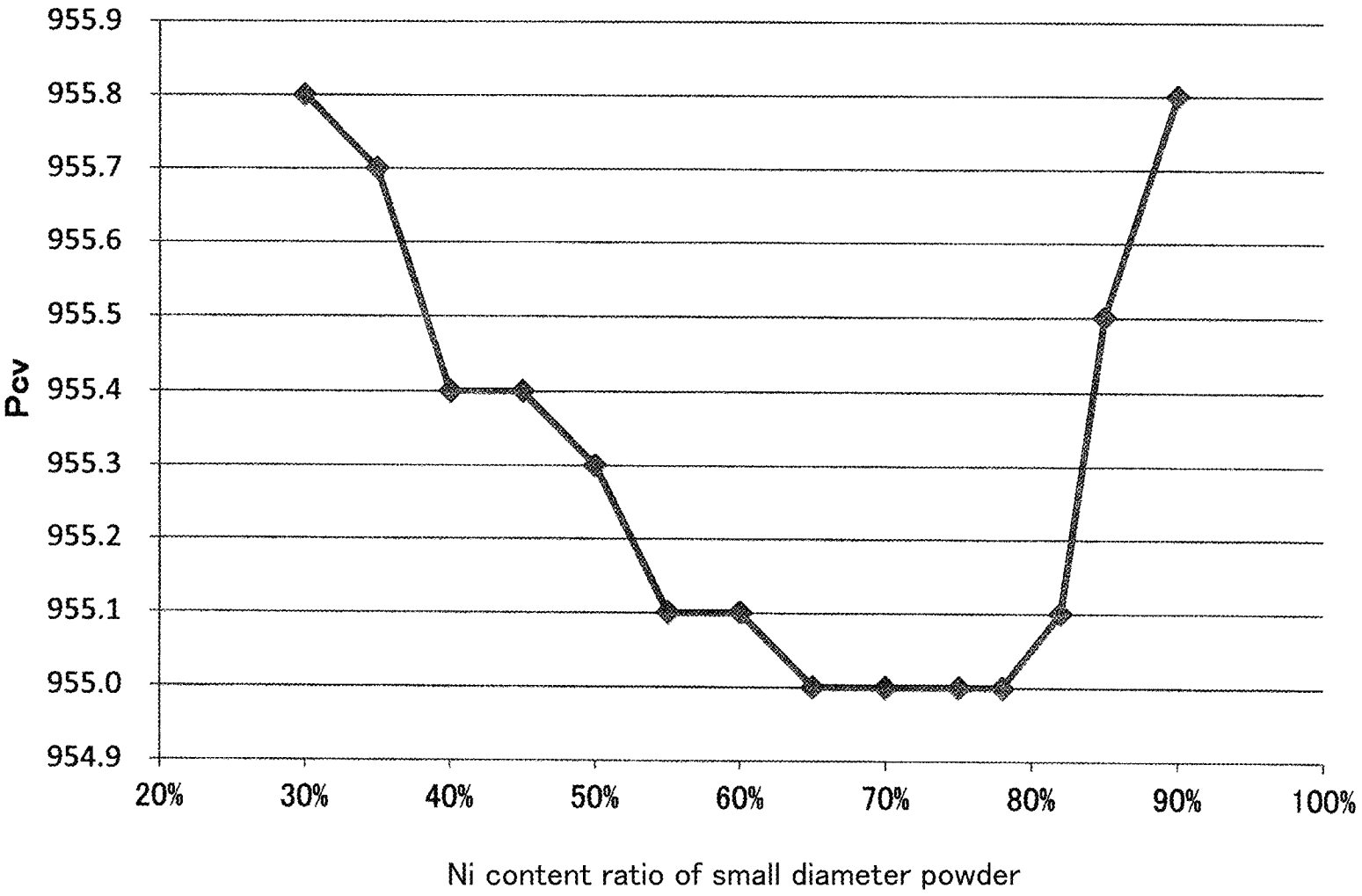
FIG. 9 is the graph showing the relation between the Ni content ratio of the small diameter powder and Pcv.

The toroidal core was produced under the same condition as the example 8 except for changing Ni content of Ni—Fe alloy used for the small intermediate powder within the range of 30 to 90%, and the characteristics were evaluated. The results are shown in Table 2, FIG. 8, and FIG. 9.

TABLE 2

| Sample No. | Blending ratio of large diameter powder | Blending ratio of intermediate diameter powder | Small diameter powder | | | | Insulation film |
|---|---|---|---|---|---|---|---|
| | | | Blending ratio | Ni content | D50 | D90 | |
| Example 21 | 75% | 12.5% | 12.5% | 90% | 0.9 μm | 1.2 μm | SiO2 |
| Example 22 | 75% | 12.5% | 12.5% | 85% | 0.9 μm | 1.2 μm | SiO2 |
| Example 23 | 75% | 12.5% | 12.5% | 82% | 0.9 μm | 1.2 μm | SiO2 |
| Example 8 | 75% | 12.5% | 12.5% | 78% | 0.9 μm | 1.2 μm | SiO2 |
| Example 24 | 75% | 12.5% | 12.5% | 75% | 0.9 μm | 1.2 μm | SiO2 |
| Example 25 | 75% | 12.5% | 12.5% | 70% | 0.9 μm | 1.2 μm | SiO2 |
| Example 26 | 75% | 12.5% | 12.5% | 65% | 0.9 μm | 1.2 μm | SiO2 |
| Example 27 | 75% | 12.5% | 12.5% | 60% | 0.9 μm | 1.2 μm | SiO2 |
| Example 28 | 75% | 12.5% | 12.5% | 55% | 0.9 μm | 1.2 μm | SiO2 |
| Example 29 | 75% | 12.5% | 12.5% | 50% | 0.9 μm | 1.2 μm | SiO2 |

TABLE 2-continued

| | | | | | | | |
|---|---|---|---|---|---|---|---|
| Example 30 | 75% | 12.5% | 12.5% | 45% | 0.9 μm | 1.2 μm | SiO2 |
| Example 31 | 75% | 12.5% | 12.5% | 40% | 0.9 μm | 1.2 μm | SiO2 |
| Example 32 | 75% | 12.5% | 12.5% | 35% | 0.9 μm | 1.2 μm | SiO2 |
| Example 33 | 75% | 12.5% | 12.5% | 30% | 0.9 μm | 1.2 μm | SiO2 |
| Comparative example 1 | 100% | 0.0% | 0.0% | | | | SiO2 |

| | | | Evaluation results | | |
|---|---|---|---|---|---|
| Sample No. | Material of large diameter powder | Type of small diameter powder | μi | Pcv (at 3 MHz) | Withstand voltage (V) |
| Example 21 | Fe based amorphous powder | Fe—Ni powder | 33.0 | 955.8 | 488 |
| Example 22 | Fe based amorphous powder | Fe—Ni powder | 38.5 | 955.5 | 492 |
| Example 23 | Fe based amorphous powder | Fe—Ni powder | 38.9 | 955.1 | 486 |
| Example 8 | Fe based amorphous powder | Fe—Ni powder | 39.0 | 955.0 | 487 |
| Example 24 | Fe based amorphous powder | Fe—Ni powder | 38.8 | 955.0 | 488 |
| Example 25 | Fe based amorphous powder | Fe—Ni powder | 37.5 | 955.0 | 480 |
| Example 26 | Fe based amorphous powder | Fe—Ni powder | 36.7 | 955.0 | 493 |
| Example 27 | Fe based amorphous powder | Fe—Ni powder | 36.3 | 955.1 | 486 |
| Example 28 | Fe based amorphous powder | Fe—Ni powder | 36.0 | 955.1 | 495 |
| Example 29 | Fe based amorphous powder | Fe—Ni powder | 35.7 | 955.3 | 499 |
| Example 30 | Fe based amorphous powder | Fe—Ni powder | 35.4 | 955.4 | 493 |
| Example 31 | Fe based amorphous powder | Fe—Ni powder | 35.0 | 955.4 | 496 |
| Example 32 | Fe based amorphous powder | Fe—Ni powder | 33.8 | 955.7 | 494 |
| Example 33 | Fe based amorphous powder | Fe—Ni powder | 33.4 | 955.8 | 498 |
| Comparative example 1 | Fe based amorphous powder | | 31.0 | 955.5 | 490 |

As shown in the examples 8, 21 to 33, when Ni content ratio of Ni—Fe alloy used for the small diameter powder was changed, the initial magnetic permeability was excellent than the comparative example 1 which is consisted only from the large diameter powder, and also other characteristics were same or better than the comparative example 1. Also, when the small diameter powders having Ni content ratio of 40 to 85% were used (the examples 8, 22 to 31), the initial magnetic permeability was 35.0 or more, which was even more preferable magnetic permeability. Further, when the small diameter powders having Ni content ratio of 75 to 82% were used (the examples 8, 23, 24), the initial magnetic permeability was 38.8 or more, which was even more preferable initial magnetic permeability.

Example 3

The toroidal core was produced under the same condition as the example 8 except that the insulation film was not formed, and the characteristics were evaluated. The results are shown in Table 3.

TABLE 3

| | Blending ratio of large diameter | Blending ratio of intermediate | Small diameter powder | | | | Insulatuion |
|---|---|---|---|---|---|---|---|
| Sample No. | powder | diameter powder | Blending ratio | Ni content | D50 | D90 | film |
| Example 8 | 75% | 12.5% | 12.5% | 78% | 0.9 μm | 1.2 μm | SiO2 |
| Comparative example 31 | 75% | 12.5% | 12.5% | 78% | 0.9 μm | 1.2 μm | None |
| Comparative example 32 | 80% | 0 | 20% | 0 | 1.0 μm | 1.3 μm | None |

| | | | Evaluation results | | |
|---|---|---|---|---|---|
| Sample No. | Material of large diameter powder | Type of small diameter powder | μi | Pcv (at 3 MHz) | Withstand voltage (V) |
| Example 8 | Fe based amorphous powder | Fe—Ni powder | 39.0 | 955.0 | 487 |
| Comparative example 31 | Fe based amorphous powder | Fe—Ni powder | 40.1 | 991.0 | 230 |
| Comparative example 32 | Fe based amorphous powder | Pure iron powder | 39.0 | 912.0 | 216 |

According to Table 3, when the insulation film is not formed (the comparative example 31), the core loss Pcv and the withstand voltage were significantly deteriorated compared to the case of forming the insulation film (the example 8). Also, when the insulation film was not formed, and the iron powder was used as the small diameter powder (the comparative example 32), the withstand voltage was significantly deteriorated compared to the case of forming the insulation film (the example 8).

Example 4

Figure 10:
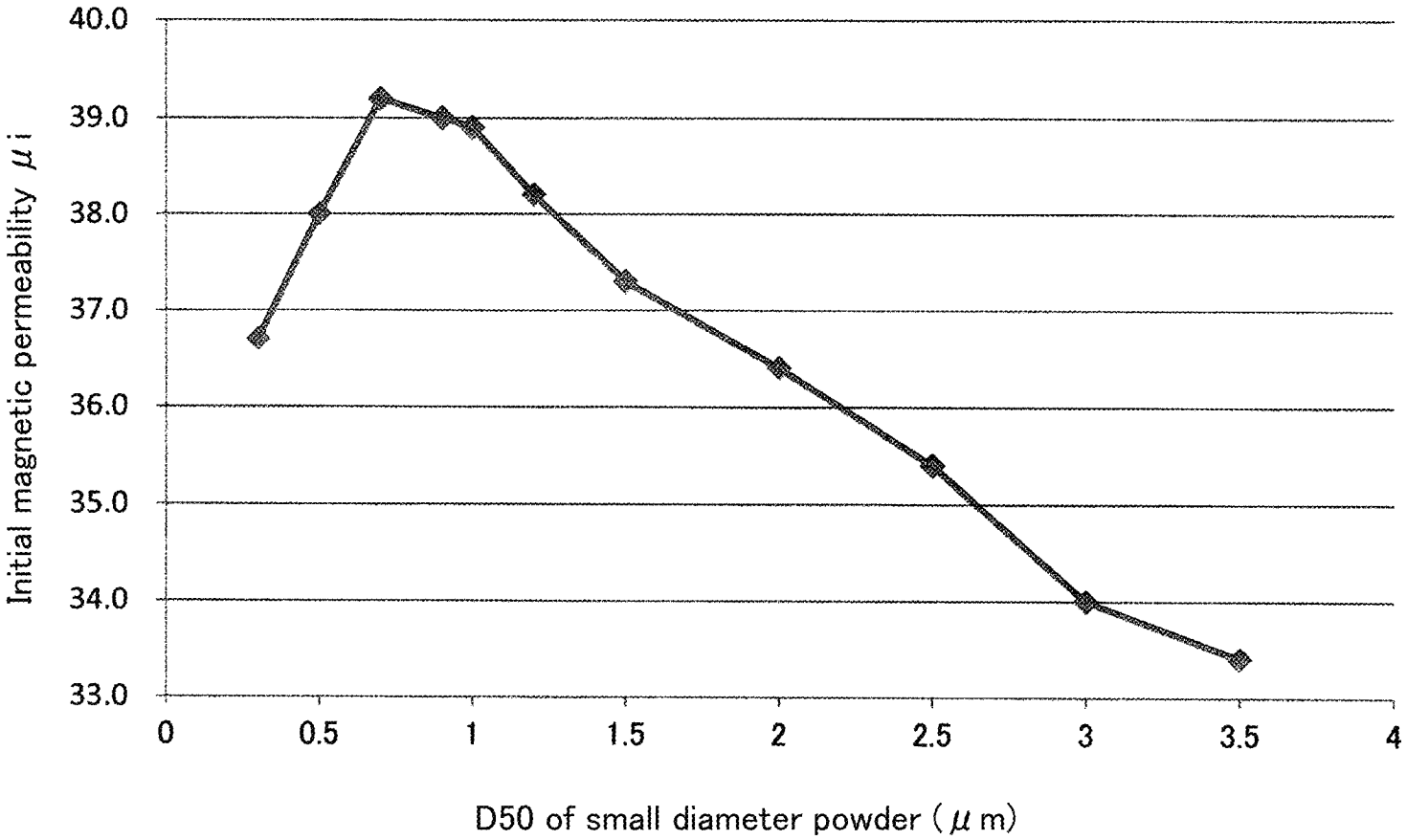
FIG. 10 is the graph showing the relation between the particle diameter of the small diameter powder and the initial magnetic permeability.
Figure 11:
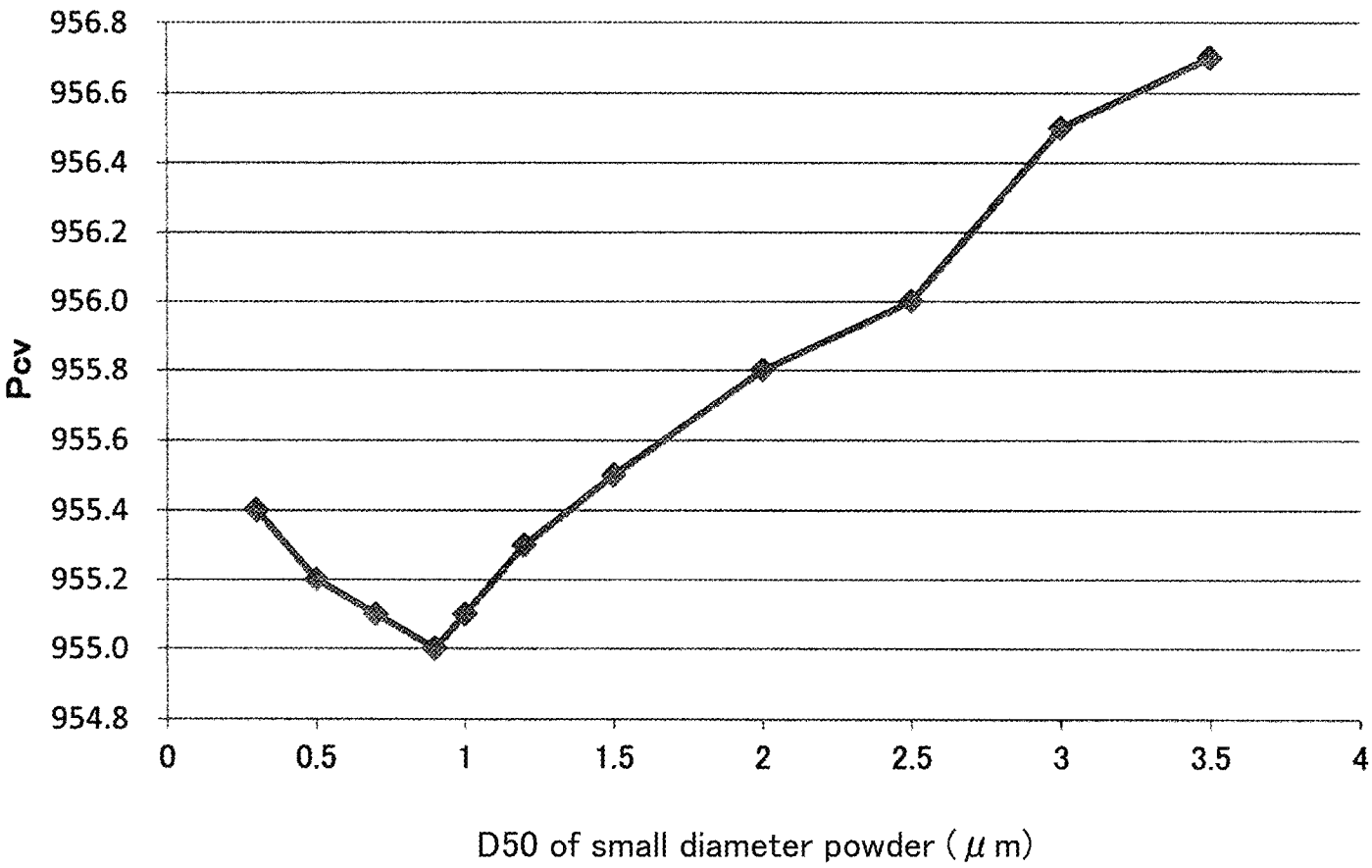
FIG. 11 is the graph showing the relation between the particle diameter of the small diameter powder and Pcv.

The toroidal core was produced under the same condition as the example 8 except that the particle diameter (D50, D90) of the small diameter powder was changed, and the characteristics were evaluated. The results are shown in Table 4, FIG. 10 and FIG. 11.

TABLE 4

| Sample No. | Blending ratio of large diameter powder | Blending ratio of intermediate diameter powder | Small diameter powder | | | | Insulation film |
|---|---|---|---|---|---|---|---|
| | | | Blending ratio | Ni content | D50 | D90 | |
| Comparative example 41 | 75% | 12.5% | 12.5% | 78% | 3.5 μm | 4.7 μm | SiO2 |
| Comparative example 42 | 75% | 12.5% | 12.5% | 78% | 3.0 μm | 4.0 μm | SiO2 |
| Comparative example 43 | 75% | 12.5% | 12.5% | 78% | 2.5 μm | 3.3 μm | SiO2 |
| Comparative example 44 | 75% | 12.5% | 12.5% | 78% | 2.0 μm | 2.7 μm | SiO2 |
| Example 45 | 75% | 12.5% | 12.5% | 78% | 1.5 μm | 2.0 μm | SiO2 |
| Example 46 | 75% | 12.5% | 12.5% | 78% | 1.2 μm | 1.6 μm | SiO2 |
| Example 47 | 75% | 12.5% | 12.5% | 78% | 1.0 μm | 1.3 μm | SiO2 |
| Example 8 | 75% | 12.5% | 12.5% | 78% | 0.9 μm | 1.2 μm | SiO2 |
| Example 48 | 75% | 12.5% | 12.5% | 78% | 0.7 μm | 0.9 μm | SiO2 |
| Example 49 | 75% | 12.5% | 12.5% | 78% | 0.5 μm | 0.7 μm | SiO2 |
| Comparative example 45 | 75% | 12.5% | 12.5% | 78% | 0.3 μm | 0.4 μm | SiO2 |
| Comparative example 1 | 100% | 0.0% | 0.0% | | | | SiO2 |

| Sample No. | Material of large diameter powder | Type of small diameter powder | Evaluation results | | |
|---|---|---|---|---|---|
| | | | μi | Pcv (at 3 MHz) | Withstand voltage (V) |
| Comparative example 41 | Fe based amorphous powder | Fe—Ni powder | 33.4 | 956.7 | 499 |
| Comparative example 42 | Fe based amorphous powder | Fe—Ni powder | 34.0 | 956.5 | 498 |
| Comparative example 43 | Fe based amorphous powder | Fe—Ni powder | 35.4 | 956.0 | 493 |
| Comparative example 44 | Fe based amorphous powder | Fe—Ni powder | 36.4 | 955.8 | 496 |
| Example 45 | Fe based amorphous powder | Fe—Ni powder | 37.3 | 955.5 | 490 |
| Example 46 | Fe based amorphous powder | Fe—Ni powder | 38.2 | 955.3 | 488 |
| Example 47 | Fe based amorphous powder | Fe—Ni powder | 38.9 | 955.1 | 489 |
| Example 8 | Fe based amorphous powder | Fe—Ni powder | 39.0 | 955.0 | 487 |
| Example 48 | Fe based amorphous powder | Fe—Ni powder | 39.2 | 955.1 | 475 |
| Example 49 | Fe based amorphous powder | Fe—Ni powder | 38.0 | 955.2 | 477 |
| Comparative example 45 | Fe based amorphous powder | Fe—Ni powder | 36.7 | 955.4 | 460 |
| Comparative example 1 | Fe based amorphous powder | | 31.0 | 955.5 | 490 |

According to Table 4, even if the particle diameter of the small diameter powder was changed, all of the characteristics were the same or better than the case of not using the small diameter powder. Also, when D50 was 0.5 to 1.5 μm, the initial magnetic permeability was 37.0 or more, which was preferable initial magnetic permeability.

Example 5

Figure 12:
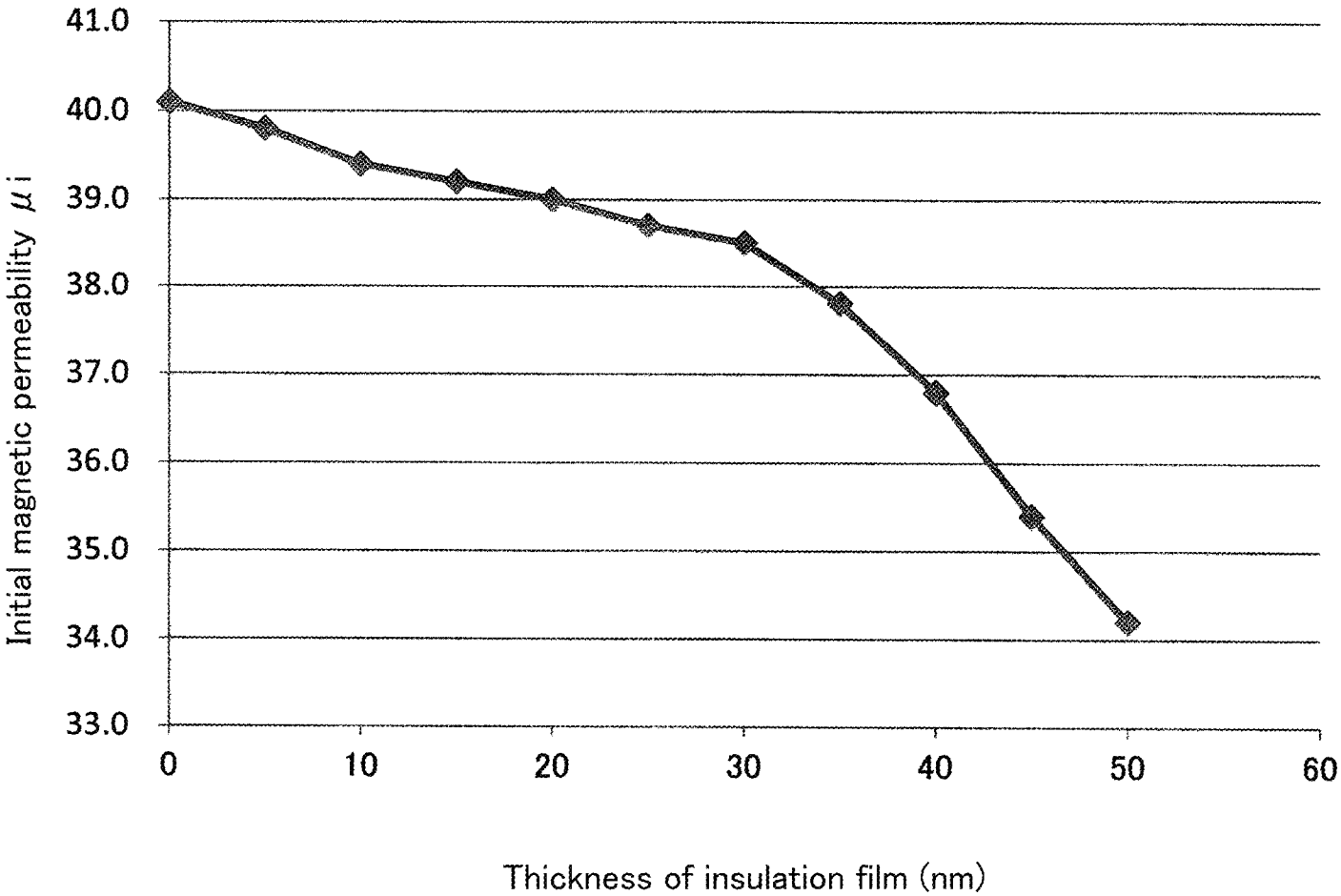
FIG. 12 is the graph showing the relation between the thickness of the insulation coating layer of the small diameter powder and the initial magnetic permeability.
Figure 13:
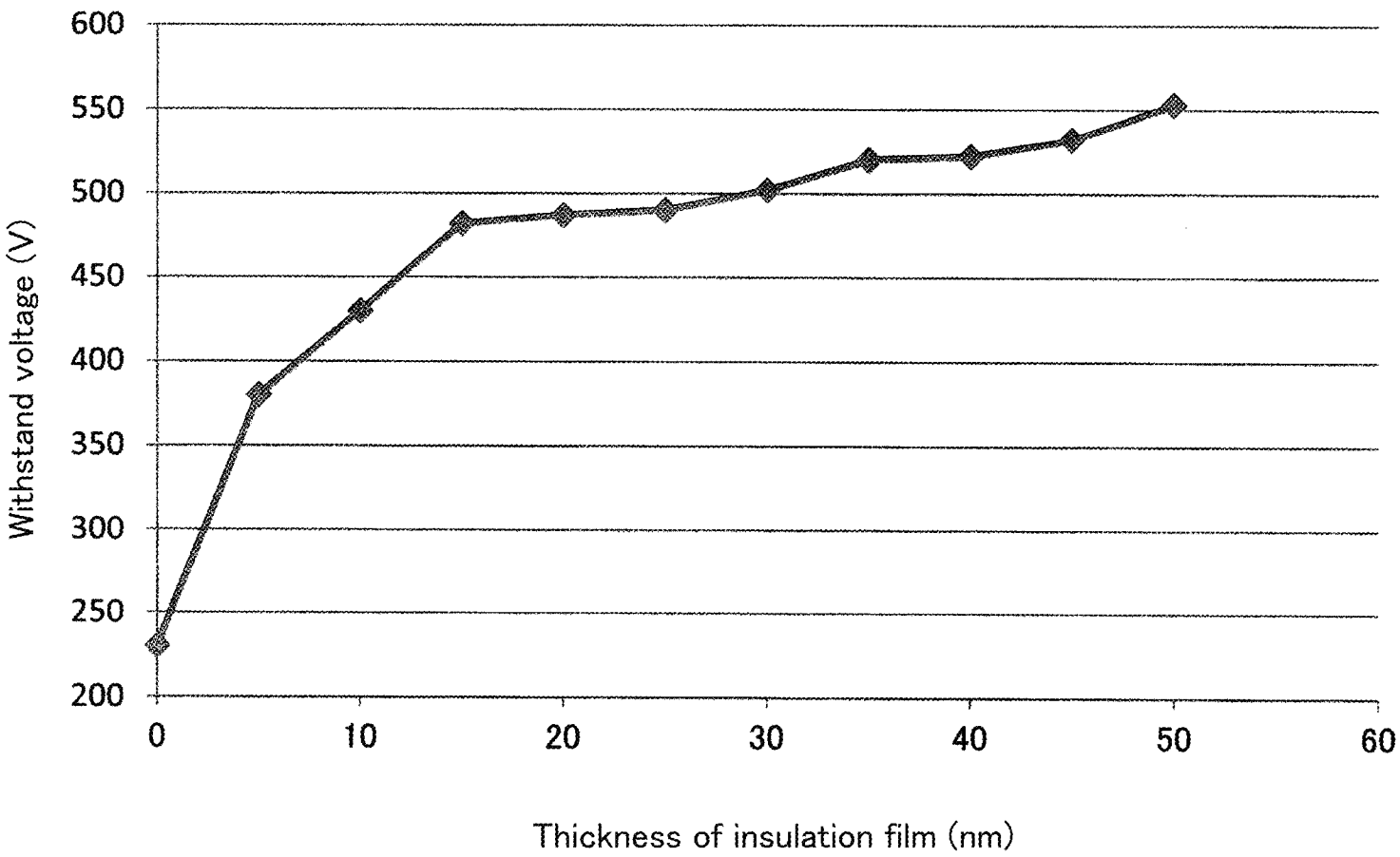
FIG. 13 is the graph showing the relation between the thickness of the insulation coating layer of the small diameter powder and the withstand voltage.

The toroidal core was produced under the same condition as the example 8 except that thickness of the insulation film was changed, and the characteristics were evaluated. The results are shown in Table 5, FIG. 12 and FIG. 13.

TABLE 5

| Sample No. | Blending ratio of large diameter powder | Blending ratio of intermediate diameter powder | Small diameter powder | | | | Insulation film (SiO2) (nm) |
|---|---|---|---|---|---|---|---|
| | | | Ni content | Blending ratio | D50 | D90 | |
| Comparative example 31 | 75% | 12.5% | 78% | 12.5% | 0.9 μm | 1.2 μm | None |
| Example 51 | 75% | 12.5% | 78% | 12.5% | 0.9 μm | 1.2 μm | 5 |
| Example 52 | 75% | 12.5% | 78% | 12.5% | 0.9 μm | 1.2 μm | 10 |
| Example 53 | 75% | 12.5% | 78% | 12.5% | 0.9 μm | 1.2 μm | 15 |
| Example 8 | 75% | 12.5% | 78% | 12.5% | 0.9 μm | 1.2 μm | 20 |
| Example 54 | 75% | 12.5% | 78% | 12.5% | 0.9 μm | 1.2 μm | 25 |
| Example 55 | 75% | 12.5% | 78% | 12.5% | 0.9 μm | 1.2 μm | 30 |
| Example 56 | 75% | 12.5% | 78% | 12.5% | 0.9 μm | 1.2 μm | 35 |
| Example 57 | 75% | 12.5% | 78% | 12.5% | 0.9 μm | 1.2 μm | 40 |
| Example 58 | 75% | 12.5% | 78% | 12.5% | 0.9 μm | 1.2 μm | 45 |
| Example 59 | 75% | 12.5% | 78% | 12.5% | 0.9 μm | 1.2 μm | 50 |
| Comparative example 1 | 100% | 0.0% | 0.0% | | | | |

| Sample No. | Material of large diameter powder | Type of small diameter powder | Evaluation results | | |
|---|---|---|---|---|---|
| | | | μi | Pcv (at 3 MHz) | Withstand voltage (V) |
| Comparative example 31 | Fe based amorphous powder | Fe—Ni powder | 40.1 | 991.0 | 230 |
| Example 51 | Fe based amorphous powder | Fe—Ni powder | 39.8 | 972.0 | 380 |
| Example 52 | Fe based amorphous powder | Fe—Ni powder | 39.4 | 965.0 | 430 |
| Example 53 | Fe based amorphous powder | Fe—Ni powder | 39.2 | 956.0 | 482 |
| Example 8 | Fe based amorphous powder | Fe—Ni powder | 39.0 | 955.0 | 487 |
| Example 54 | Fe based amorphous powder | Fe—Ni powder | 38.7 | 953.0 | 490 |
| Example 55 | Fe based amorphous powder | Fe—Ni powder | 38.5 | 951.0 | 502 |
| Example 56 | Fe based amorphous powder | Fe—Ni powder | 37.8 | 950.0 | 520 |
| Example 57 | Fe based amorphous powder | Fe—Ni powder | 36.8 | 947.0 | 522 |
| Example 58 | Fe based amorphous powder | Fe—Ni powder | 35.4 | 940.0 | 532 |
| Example 59 | Fe based amorphous powder | Fe—Ni powder | 34.2 | 932.0 | 553 |
| Comparative example 1 | Fe based amorphous powder | | 31.0 | 955.5 | 490 |

According to Table 5, even when the thickness of the insulation film was changed, all of the characteristics were same or better than the case of not using the small diameter powder. Also, when the thickness of the insulation film was 5 to 45 nm (the examples 8, 51 to 58), the initial magnetic permeability was 35.0 or more, which was preferable initial magnetic permeability. Further, when the thickness of the insulation film was 10 to 35 nm (the examples 8, 52 to 56), the initial magnetic permeability was 37.5 or more and the withstand voltage was 400 V or more, which were even more preferable characteristics.

Example 6

Figure 14:
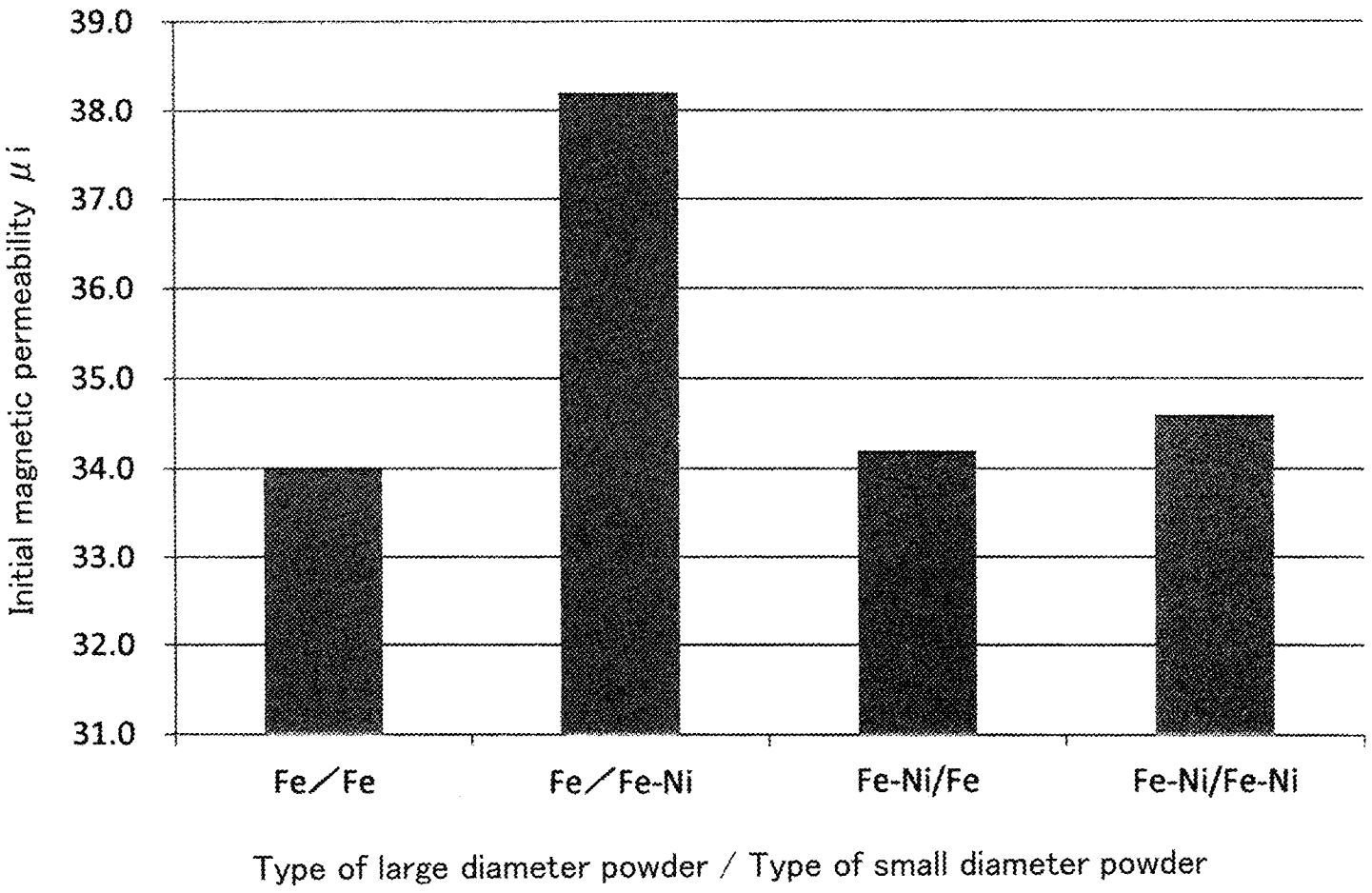
FIG. 14 is the graph showing the relation between the initial magnetic permeability, and the types of the large diameter powder and the small diameter powder.
Figure 15:
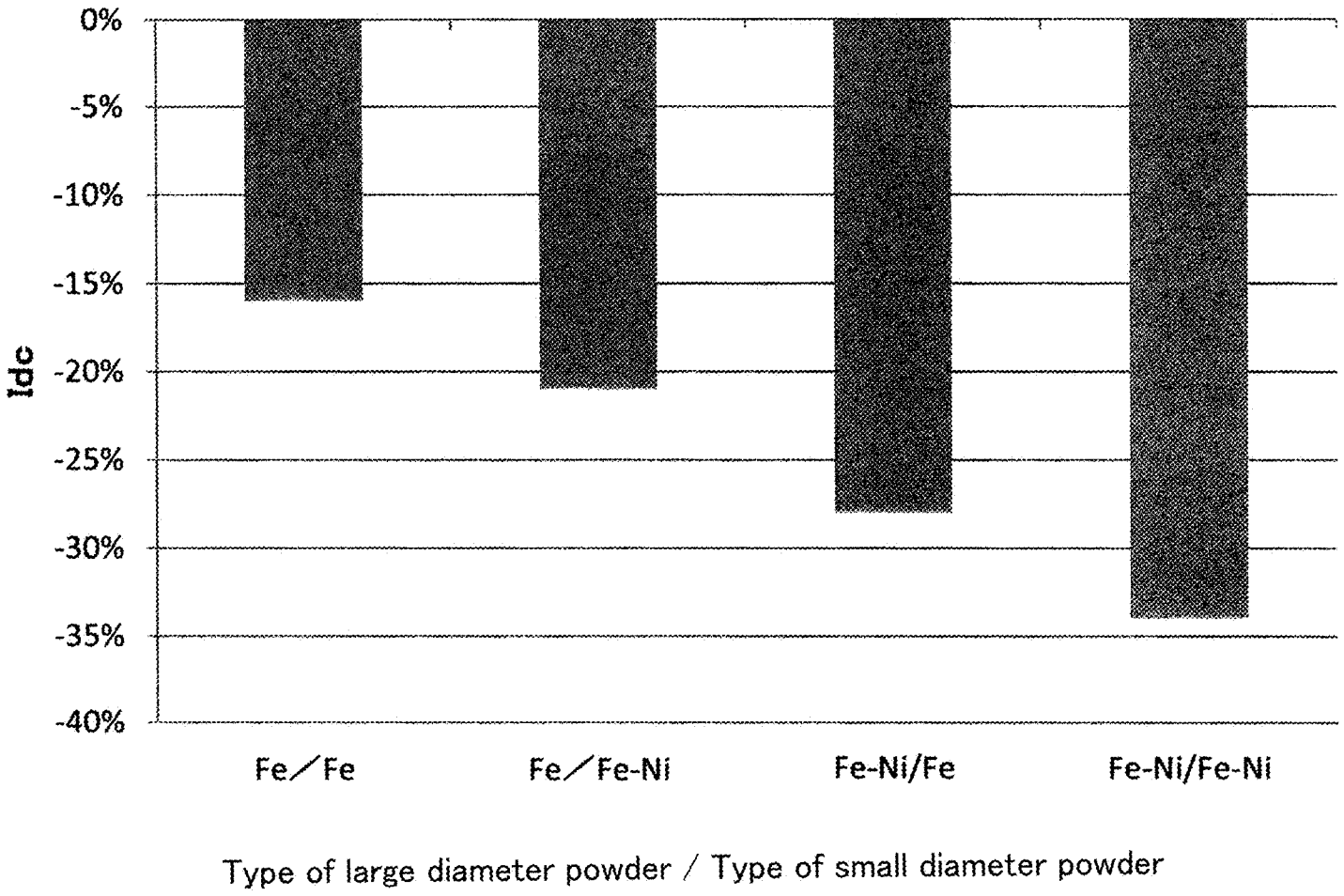
FIG. 15 is the graph showing the relation between DC superimposition characteristic, and the types of the large diameter powder and the small diameter powder.

The toroidal core was produced under the same condition as the example 46 except that the type of each magnetic the small diameter powder was made constant, that is the distribution of the particle diameter of the small diameter metal powder was changed, and the characteristics were evaluated. The results are shown in Table 6, FIG. 14 and FIG. 15.

Note that, in the example 6, other than the above mentioned characteristics, DC superimposition characteristic (Idc) was measured. In the present example, the inductance when it was not electrically conducted, and the inductance when DC current 10 A was conducted were measured, and the change of the inductance before and after the DC current conductance were measured. In the present example, when the absolute value of Idc was 25% or less, then it was evaluated good.

TABLE 6

| | | | | Evaluation results | | | |
|---|---|---|---|---|---|---|---|
| Sample No. | Material of large diameter powder | Material of intermediate diameter powder | Material of small diameter powder | μi | Pcv (at 3 MHz) | Withstand voltage (V) | Idc ※Change rate L when 10 A current is conducted |
| Comparative example 61 | Fe based amorphous powder | Pure iron powder | Pure iron powder | 34.0 | 919.3 | 485 | −16% |
| Example 46 | Fe based amorphous powder | Pure iron powder | Fe—Ni powder | 38.2 | 955.3 | 488 | −21% |
| Comparative example 62 | Fe—Ni powder | Pure iron powder | Pure iron powder | 34.2 | 967.0 | 486 | −28% |
| Comparative example 63 | Fe—Ni powder | Pure iron powder | Fe—Ni powder | 34.6 | 953.0 | 488 | −34% |

According to Table 6, when the large diameter powder and the intermediate diameter powder were iron powder, and the small diameter powder was Ni—Fe alloy powder (the example 46), all of the characteristics were the same or more than the case of other combinations (the comparative examples 61 to 63), and particularly the initial magnetic permeability and the DC superimposition characteristic were good.

Example 7

Figure 16:
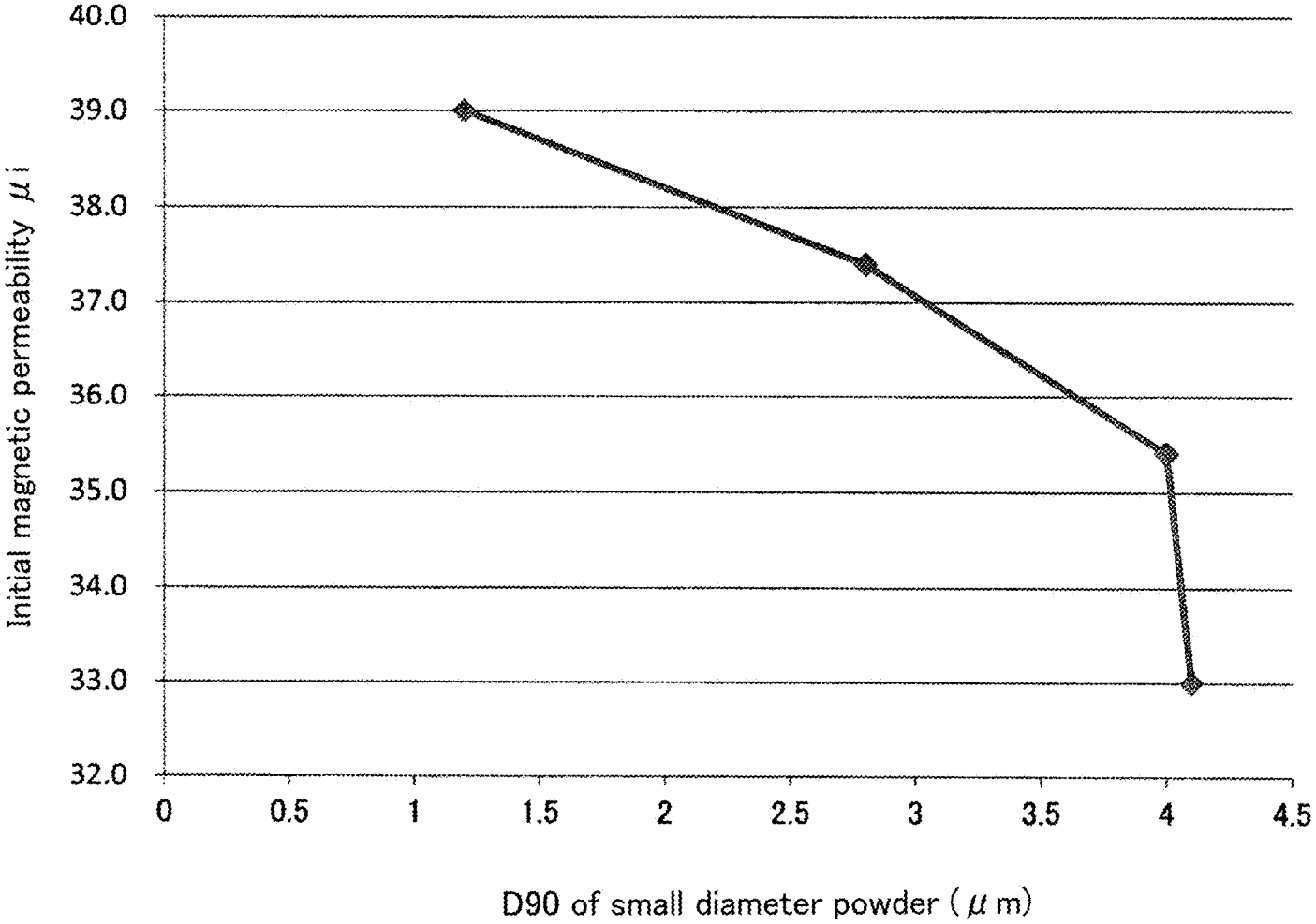
FIG. 16 is the graph showing the relation between D90 of the small diameter powder and the initial magnetic permeability.
Figure 17:
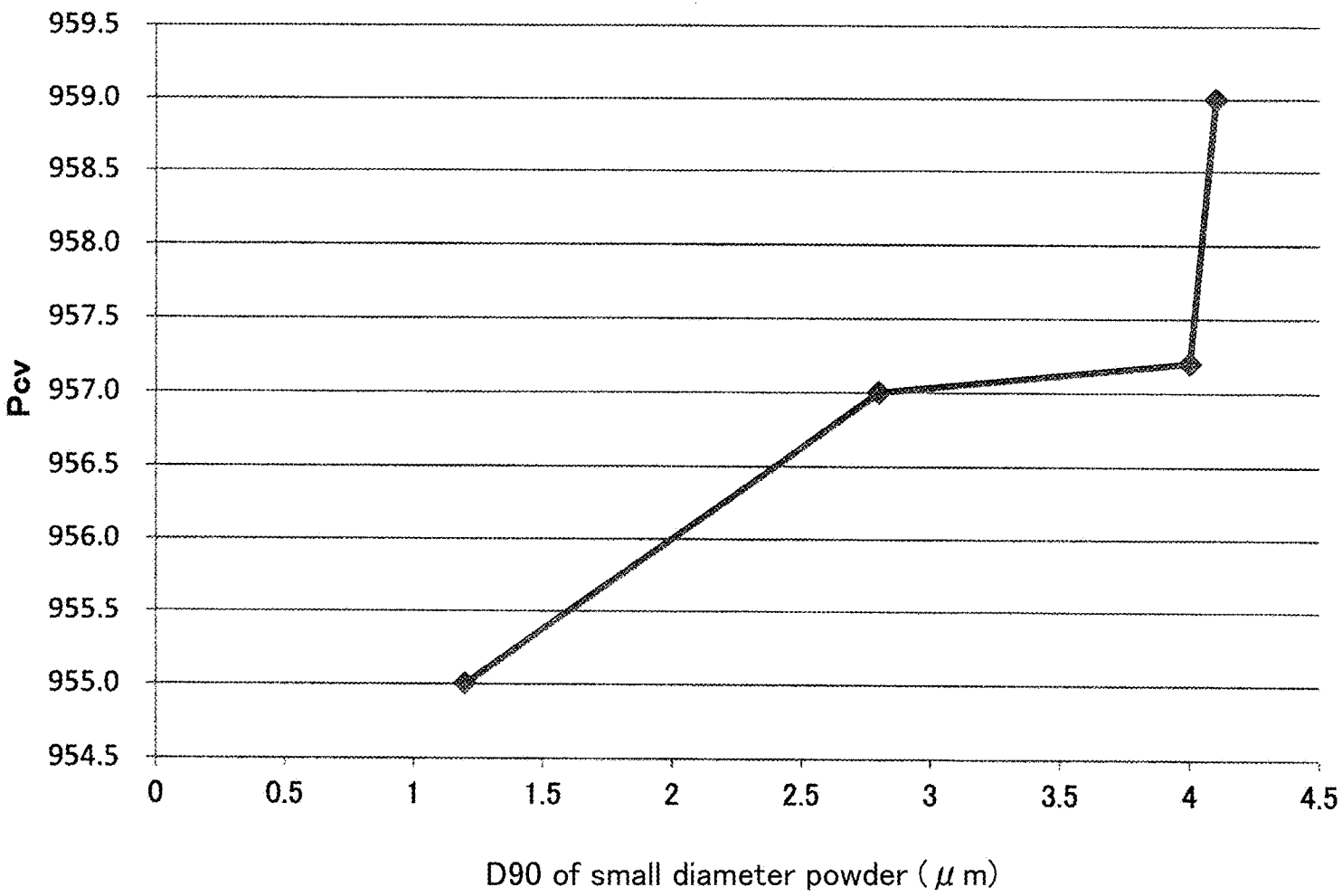
FIG. 17 is the graph showing the relation between D90 and Pcv.

The toroidal core was produced under the same condition as the example 8 except that D90 was changed and D50 of powder was changed, and the characteristics were evaluated. The results are shown in Table 7, FIG. 16 and FIG. 17.

TABLE 7

| Sample No. | Blending ratio of large diameter powder | Blending ratio of intermediate diameter powder | Small diameter powder Ni content | Blending ratio | D50 | D90 | Insulation film |
|---|---|---|---|---|---|---|---|
| Example 8 | 75% | 12.5% | 78% | 12.5% | 0.9 μm | 1.2 μm | SiO2 |
| Example 71 | 75% | 12.5% | 78% | 12.5% | 0.9 μm | 2.8 μm | SiO2 |
| Example 72a | 75% | 12.5% | 78% | 12.5% | 0.9 μm | 4.0 μm | SiO2 |
| Example 72a | 75% | 12.5% | 78% | 12.5% | 0.9 μm | 4.1 μm | SiO2 |

| Sample No. | Material of large diameter powder | Material of small diameter powder | Evaluation results μi | Pcv (at 3 MHz) | Withstand voltage (V) |
|---|---|---|---|---|---|
| Example 8 | Fe based amorphous powder | Fe—Ni powder | 39.0 | 955.0 | 487 |
| Example 71 | Fe based amorphous powder | Fe—Ni powder | 37.4 | 957.0 | 486 |
| Example 72a | Fe based amorphous powder | Fe—Ni powder | 35.4 | 957.2 | 486 |
| Example 72a | Fe based amorphous powder | Fe—Ni powder | 33.0 | 959.0 | 486 |

According to Table 7, all of the characteristics were good even when the distribution of the particle diameter of the small diameter powder was changed. Also, when D90 was 4.0 μm or less (the examples 8 and 71), the magnetic permeability was significantly excellent compared to the case when D90 was more than 4.0 (the example 72).

Example 8

The core element body shown in FIG. 1 to FIG. 4A and FIG. 4B were produced using the magnetic metal powder containing resin used in the above mentioned examples 1 to 72 and the comparative examples 1 to 63, thereby the coil device shown in FIG. 1 to FIG. 4A and FIG. 4B were produced. The coil device using the magnetic metal powder containing resin used in the examples 1 to 72 had good characteristics such as the initial magnetic permeability, the core loss and the withstand voltage or so.

NUMERICAL REFERENCES

2 . . . Coil device
4 . . . Terminal electrode
4*a* . . . Inner layer
4*b* . . . Outer layer
10 . . . Core element body
11 . . . Insulation board
12, 13 . . . Internal conductor path
12*a*, 13*a* . . . Connecting end
12*b*, 13*b* . . . Lead contact
14 . . . Protective insulation layer
15 . . . Upper core
15*a* . . . middle leg part
15*b* . . . Side leg part
16 . . . Lower core
18 . . . Through hole electrode
20 . . . Magnetic metal powder comprising the insulation coating layer
22 . . . Insulation coating layer

The invention claimed is:

1. A coil device comprising a coil, and a magnetic metal powder containing resin covering said coil, wherein
said magnetic metal powder comprises at least three types of magnetic metal powders with different D50,
the magnetic metal powder having largest D50 is defined as a large diameter powder, the magnetic metal powder having smallest D50 is defined as a small diameter powder, and the magnetic metal powder having smaller D50 than said large diameter powder and also having larger D50 than said small diameter powder is defined as an intermediate diameter powder among the three types of said magnetic metal powder,
said large diameter powder is made of iron or iron based alloy,
said large diameter powder has D50 of 15 to 40 μm,
said small diameter powder is made of Ni—Fe alloy,
said small diameter powder has D50 of 0.5 to 1.5 μm,
said small diameter powder has D90 of 4.0 μm or less,
the blending ratio of said small diameter powder in entire said magnetic metal powder is 6.5 to 20%,
said large diameter powder and said small diameter powder respectively comprises an insulation coating layer,
a thickness of said insulation coating layer of said small diameter powder is 5 to 15 nm, wherein said insulation coating layer provides electrical insulation,
a thickness of said insulation coating layer of said large diameter powder is 10 to 35 nm, and
said thickness of said insulation coating layer of said large diameter powder is thicker than said thickness of said insulation coating layer of said small diameter powder.

2. The coil device as set forth in claim 1, wherein said small diameter powder has D50 of 0.5 μm or more and less than 1.0 μm.

3. The coil device as set forth in claim 1, wherein at least said small diameter powder is spherical.

4. The coil device as set forth in claim 1, wherein a content ratio of Ni in said Ni—Fe alloy is 75 to 82%.

5. The coil device as set forth in claim 1, wherein said insulation coating layer includes a glass comprising $SiO_2$.

6. The coil device as set forth in claim 1, wherein said insulation coating layer includes phosphates.

7. The coil device as set forth in claim 1, wherein said intermediate diameter powder comprises an insulation coating layer.

8. The coil device as set forth in claim 1, wherein said intermediate diameter powder has D50 of 3.0 to 10 μm.

9. The coil device as set forth in claim 1, wherein said intermediate diameter powder is made of iron or iron based alloy.

10. The coil device as set forth in claim 1, wherein the blending ratio of said large diameter powder in said entire magnetic metal powder is 70 to 80%, and the blending ratio of said intermediate diameter powder is 10 to 15%, and the blending ratio of said small diameter powder is 10 to 15%.

11. A magnetic metal powder containing resin used for the coil device according to claim 1.

12. A magnetic metal powder used for the coil device according to claim 1.

13. A coil device comprising a coil, and a magnetic metal powder containing resin covering said coil, wherein
said magnetic metal powder comprises at least three types of magnetic metal powders with different D50,
the magnetic metal powder having largest D50 is defined as a large diameter powder, the magnetic metal powder having smallest D50 is defined as a small diameter powder, and the magnetic metal powder having smaller D50 than said large diameter powder and also having larger D50 than said small diameter powder is defined as an intermediate diameter powder among the three types of said magnetic metal powder,
said large diameter powder is made of iron or iron based alloy,
said small diameter powder is made of Ni—Fe alloy,
said small diameter powder has D50 of more than 0.3 μm and less than 2.0 μm,
said small diameter powder has D90 of 4.0 μm or less,
the blending ratio of said small diameter powder in entire said magnetic metal powder is 6.5 to 20%,
said large diameter powder and said small diameter powder respectively comprises an insulation coating layer,
a thickness of said insulation coating layer of said small diameter powder is 5 to 15 nm, wherein said insulation coating layer provides electrical insulation,
a thickness of said insulation coating layer of said large diameter powder is 10 to 35 nm, and
said thickness of said insulation coating layer of said large diameter powder is thicker than said thickness of said insulation coating layer of said small diameter powder.

14. A magnetic metal powder containing resin used for the coil device according to claim 13.

15. A magnetic metal powder used for the coil device according to claim 13.

* * * * *